US007112768B2

(12) United States Patent
Brochu et al.

(10) Patent No.: US 7,112,768 B2
(45) Date of Patent: Sep. 26, 2006

(54) TEMPERATURE CONTROL SYSTEM FOR A BATHING UNIT

(75) Inventors: Christian Brochu, Quebec (CA); Jean Bizouard, Loretteville (CA); Benoit Laflamme, Quebec (CA)

(73) Assignee: 9090-3493 Quebec Inc., Quebec (CA)

( * ) Notice: Subject to any disclaimer, the term of this patent is extended or adjusted under 35 U.S.C. 154(b) by 228 days.

(21) Appl. No.: 10/768,062

(22) Filed: Feb. 2, 2004

(65) Prior Publication Data

US 2005/0167419 A1 Aug. 4, 2005

(51) Int. Cl.
*H05B 1/02* (2006.01)

(52) U.S. Cl. ..... 219/494; 219/497; 219/501; 219/483; 219/518; 4/541.1; 392/471; 392/465

(58) Field of Classification Search ..... 219/480–486, 219/502, 518, 497, 494; 4/541.1; 392/44, 392/465, 471; 340/518
See application file for complete search history.

(56) References Cited

U.S. PATENT DOCUMENTS 4,029,937 A * 6/1977 Russell ..... 392/318
4,638,147 A * 1/1987 Dytch et al. ..... 392/485
5,019,690 A * 5/1991 Knepler ..... 219/400
5,216,743 A * 6/1993 Seitz ..... 392/490
5,308,957 A * 5/1994 Huffington ..... 219/483
6,282,370 B1 8/2001 Cline et al.
6,476,363 B1 * 11/2002 Authier et al. ..... 219/481
6,590,188 B1 * 7/2003 Cline et al. ..... 219/497
6,836,615 B1 * 12/2004 Bradenbaugh ..... 392/449
6,847,291 B1 * 1/2005 Kemp ..... 340/521
2001/0029407 A1 * 10/2001 Tompkins et al. ..... 700/300
2002/0089236 A1 7/2002 Cline et al.

FOREIGN PATENT DOCUMENTS

WO WO 2004/034742 A1 4/2004

* cited by examiner

*Primary Examiner*—Mark Paschall

(57) ABSTRACT

A temperature control system for a bathing unit that includes a water holding receptacle and a heating module. The temperature control system comprises a plurality of actuators associated to the heating module and a temperature regulation device in communication with the actuators. The plurality of actuators are adapted for acquiring a first set of actuation patterns for causing the heating module to acquire a non-heating state and a second set of actuation patterns for causing the heating module to acquire a heating state. The temperature regulation device is operative for controlling the plurality of actuators to cause the heating module to acquire either one of the heating state or the non-heating state and for selecting a configuration from the first set of actuation patterns for causing the heating module to acquire the non-heating state. Alternatively, the temperature control system includes a solid state device associated with the heating module.

72 Claims, 11 Drawing Sheets

TEMPERATURE CONTROL SYSTEM FOR A BATHING UNIT

FIELD OF THE INVENTION

The present invention relates to a temperature control system for a bathing unit. More specifically, the present invention relates to a temperature control system for a bathing unit that is operative to maintain the water temperature of the bathing unit within a certain temperature range.

BACKGROUND OF THE INVENTION

Bathing units, such as spas, whirlpools, hot tubs, bathtubs and swimming pools, often include a water holding receptacle, water pumps, a heating module to heat the water, a filter system, an air blower, a lighting system, and a control system for activating and managing the various parameters of the bathing unit components.

In use, the water pumps typically circulate the water between the water holding receptacle and the heating module in order to heat the water. The heating module is typically controlled by a temperature regulation device which selectively activates/deactivates the heating module in order to set and maintain the water in the bathing unit within a temperature range associated to a desired temperature. A risk associated with heating the water in the bathing unit is that the temperature regulation device, or actuators for activating and deactivating the heating module might malfunction, which could cause the water temperature in the bathing u nit to become unsafe. Accordingly, various safety regulation agencies, such as UL, CSA and TUV, have made certain requirements for bathing units in order to avoid injuries due to unsafe water temperatures. As such, most bathing units are equipped with safety devices that are independent of the temperature regulation device, such that if the water temperature becomes too hot, the safety devices are able to prevent the heating module from continuing to heat the water.

Typically, the temperature regulation device is operative for controlling the activation/deactivation of the heating module by controlling an actuator, such as a relay or switch, which controls the voltage applied to the heating module. A deficiency with such systems is that the burden of causing the heating module to be activated and deactivated is placed on one actuator. Standard relay actuators do not provide a lifetime exceeding approximately 100,000 cycles at full load. As such, after 5–10 years, the relay actuator will fail and will need to be replaced. This is often both costly and frustrating for the bathing unit owner, since the complete bathing unit temperature control system usually needs to be returned for replacement.

In addition, the temperature regulation device is operative for controlling the activation/deactivation of a water pump which circulates water between the water receptacle and the heating module. Generally, the temperature regulation device controls the activation/deactivation of the water pump by controlling an actuator, such as a relay or switch, which controls the voltage applied to the water pump. An additional deficiency with temperature control systems as described above, is that the water pump and/or the actuator, also has a finite life expectance, after which time the water pump will need to be replaced.

Against the background described above, it appears that there is a need in the industry to provide a temperature control system suitable for a bathing unit that alleviates at least in part the problems associated with the existing bathing units.

SUMMARY OF THE INVENTION

In accordance with a broad aspect, the present invention provides a temperature control system for a bathing unit. The bathing unit includes a receptacle for holding water and a heating module for heating the water supplied to the receptacle. The temperature control system comprises a plurality of actuators associated to the heating module and a temperature regulation device in communication with the plurality of actuators. The plurality of actuators are adapted for acquiring a first set of actuation patterns for causing the heating module to be in a non-heating state, wherein the first set of actuation patterns includes at least two configurations, and a second set of actuation patterns for causing the heating module to be in a heating state, wherein the second set of actuation patterns includes at least one configuration. The temperature regulation device is operative for controlling the plurality of actuators such as to cause the heating module to be in either one of the heating state or the non-heating state. The temperature regulation device is adapted for selecting a configuration from the first set of actuation patterns for causing the heating module to be in the non-heating state.

In accordance with another broad aspect, the present invention provides a method for controlling the water temperature of a bathing unit. The bathing unit includes a receptacle for holding the water, a heating module for heating the water supplied to the receptacle, and a plurality of actuators associated to the heating module. The plurality of actuators are adapted for acquiring a first set of actuation patterns for causing the heating module to be in a non-heating state, wherein the first set of actuation patterns includes at least two configurations, and a second set of actuation patterns for causing the heating module to be in a heating state, wherein the second set of actuation patterns includes at least one configuration. The method comprises receiving a signal indicative of a water temperature, processing the signal indicative of a water temperature on the basis of a desired water temperature to derive a control signal, and controlling the plurality of actuators such as to cause the heating module to acquire either one of a heating state or a non-heating state on the basis of the control signal. The method further comprises selecting a configuration from the first set of actuation patterns when the control signal indicates that the heating module should acquire the non-heating state.

In accordance with yet another broad aspect, the present invention provides a method for controlling the heating of water in a bathing unit. The bathing unit includes a receptacle for holding water, a heating module for heating the water supplied to the receptacle and a pump for circulating the water between the receptacle and the heating module. The method comprises intermittently causing the activation of the pump to cause water to circulate between the receptacle and the heating module, wherein the activation of the pump occurs after a certain delay time after a deactivation of the pump. The method also includes modifying the certain delay time at least in part on the basis of temperature measurements of the water taken between successive activations of the pump.

In accordance with yet another broad aspect, the present invention provides a temperature control system for a bathing unit. The bathing unit includes a receptacle for holding water, a heating module for heating the water supplied to the receptacle and a pump for circulating the water between the receptacle and the heating module. The temperature control system comprises a temperature sensor for measuring the temperature of the water and a temperature regulation device in communication with the temperature sensor. The temperature regulation device is operative for intermittently causing the activation of the pump to cause water to circulate between the receptacle and the heating module, wherein an activation of the pump occurs after a certain delay time after the deactivation of the pump. The temperature regulation device is also adapted for modifying the certain delay time at least in part on the basis of temperature measurements of the water taken between successive activations of the pump.

In accordance with another broad aspect, the invention provides a method for controlling the heating of water in a bathing unit, wherein the bathing unit includes a receptacle for holding water, a heating module for heating the water supplied to the receptacle and a pump for circulating the water between the receptacle and the heating module. The method comprises intermittently causing activation of the pump to cause water to circulate between the receptacle and the heating module. An activation of the pump occurs after a certain delay time after a deactivation of the pump. The method further comprises modifying the certain delay time at least in part on the basis of an ambient air temperature measurement.

In accordance with yet another broad aspect, the invention provides a temperature control system for a bathing unit, wherein the bathing unit includes a receptacle for holding water. The temperature control system comprises a circulation system through which water can flow and a solid state device. The circulation system comprises a heating module for heating the water supplied to the receptacle and circulation piping for connecting the heating module to the receptacle. The solid state device is operative for controlling the power supplied to the heating module, and is positioned in a thermally conductive relationship with the water in the circulation system, such as to allow heat to dissipate from the solid state device to the water in the circulation system.

Finally, in accordance with yet another broad aspect, the invention provides a temperature control system for a bathing unit, wherein the bathing unit includes a receptacle for holding water and a heating module for heating the water supplied to the receptacle. The temperature control system comprises at least one solid state device associated to the heating module, and a temperature regulation device. The solid state device is adapted for supplying power to the heating module and the temperature regulation device is in communication with the solid state device for controlling the solid state device such as to regulate the amount of power supplied to the heating module.

These and other aspects and features of the present invention will now become apparent to those of ordinary skill in the art upon review of the following description of specific embodiments of the invention in conjunction with the accompanying drawings.

BRIEF DESCRIPTION OF THE DRAWINGS

A detailed description of examples of implementation of the present invention is provided hereinbelow with reference to the following drawings, in which.

Figure 1:
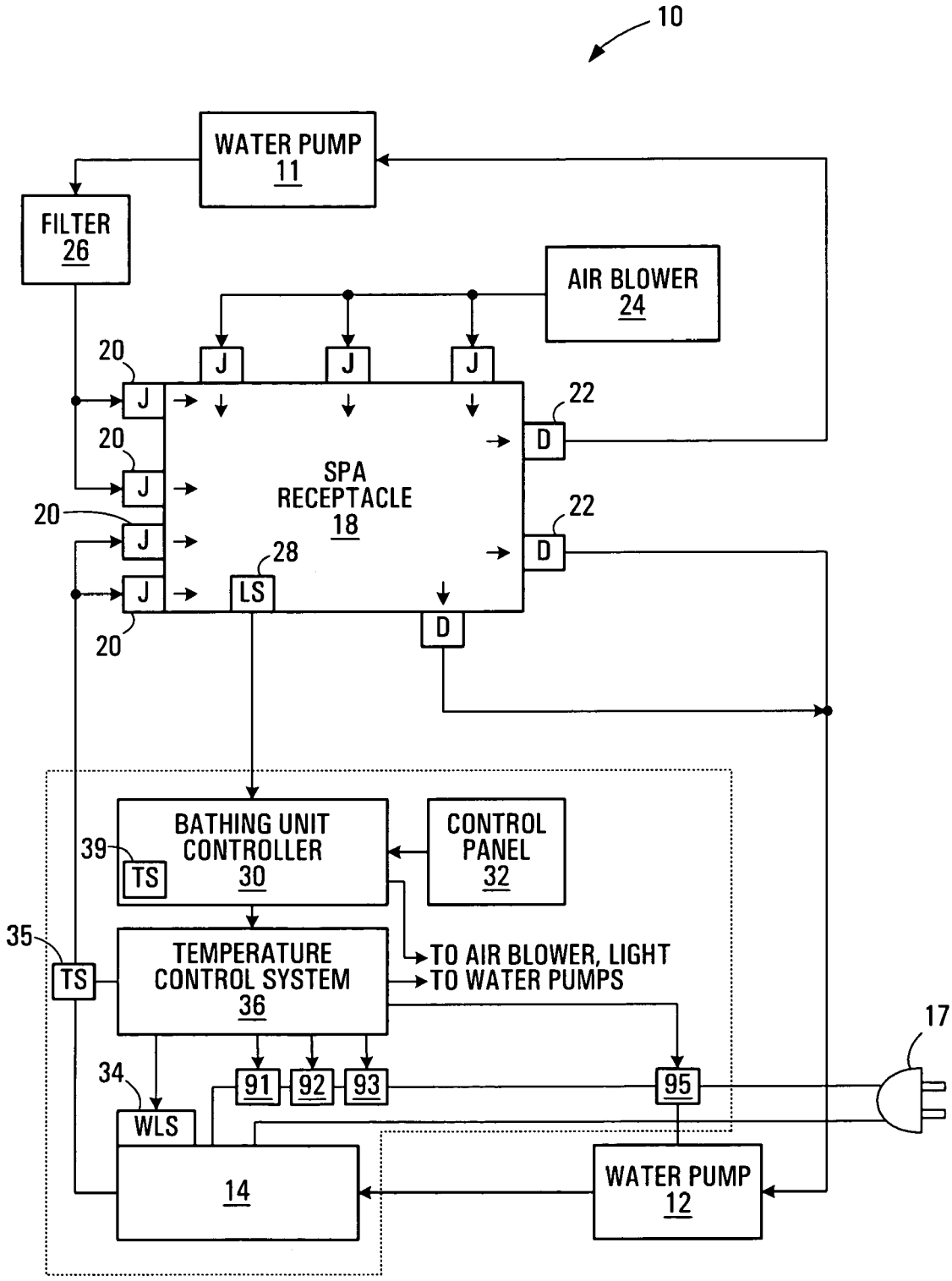
FIG. 1 shows a bathing unit system equipped with a control system in accordance with a non-limiting example of implementation of the present invention.

In the drawings, embodiments of the invention are illustrated by way of example. It is to be expressly understood that the description and drawings are only for the purposes of illustration and as an aid to understanding, and are not intended to be a definition of the limits of the invention.

DETAILED DESCRIPTION

FIG. 1 illustrates a block diagram of a bathing unit system 10 in accordance with a specific example of implementation of the present invention. It is to be understood that the expressions "bathing unit" and "bathing unit system", as used for the purposes of the present description, refer to spas, whirlpools, hot tubs, bath tubs, swimming pools and any other type of bathing receptacle that can be equipped with a control system for controlling various operational settings.

The bathing unit system 10 shown in FIG. 1, includes a water receptacle 18 for holding water, a plurality of jets 20, one or more water pumps 11 & 12, a set of drains 22, a heating module 14 and a control system 33. In normal operation, water flows from the water receptacle 18, through a drain 22 and is pumped by water pump 12 through the heating module 14 where the water is heated. The heated water then leaves the heating module 14 and re-enters the water receptacle 18 through jets 20. This cycle of water leaving the water receptacle 18 through drain 22, passing through the heating module 14 and re-entering the water receptacle 18 through the jets 20 is repeated while water pump 12 is activated.

In addition, in normal use, the water also passes through a cycle wherein the water flows from the water receptacle 18, through a different drain 22 and is pumped by water pump 11 through a filter 26. After having been filtered, the water then re-enters the water receptacle through different jets 20. This cycle of water leaving the water receptacle 18 through drain 22, passing through the filter 26 and re-entering the water receptacle 18 through the jets 20 can be repeated on a continual basis, in order to keep the water clean from particulate impurities.

Optionally, in a non-limiting embodiment, the bathing unit system 10 can also include an air blower 24 for delivering air bubbles to the water receptacle 18, a light system 28 and any other device suitable for use in connection with a bathing unit.

The control system 33 is operative for controlling the various components of the bathing unit system 10. In the non-limiting example of implementation shown in FIG. 1, the control system 33 includes a control panel 32, a bathing unit controller 30, a temperature control system 36, a plurality of sensors including a water level sensor 34, water temperature sensors 35, 37, and a plurality of actuators 91 through 93, and 95. As will be described in more detail below, the water level sensor 34 can be a capacitive water level sensor. A more detailed description of a capacitive water level sensor can be found in copending U.S. patent application Ser. No. 10/651,949 the contents of which are incorporated herein by reference.

The control panel 32 is typically in the form of a user interface for allowing a user to control various operational settings of the bathing unit. Some non-limiting examples of operational settings of the bathing unit include a temperature control setting, jet control settings and light control settings.

For the purpose of clarity, the bathing unit controller 30 and the temperature control system 36 are shown as separate components that are each able to control operational settings of the components of the bathing unit system 10. It will be appreciated that the functionality of the temperature control system 36 and the bathing unit controller 30 may be partially or fully integrated with one another without detracting from the spirit of the invention. For example, practical implementations of the invention may have either separate physical components for the bathing unit controller 30 and the temperature control system 36, or a same component where the functionality of the temperature control system 36 and bathing unit controller 30 are integrated.

Controlling the Heating Module 14

Figure 2:
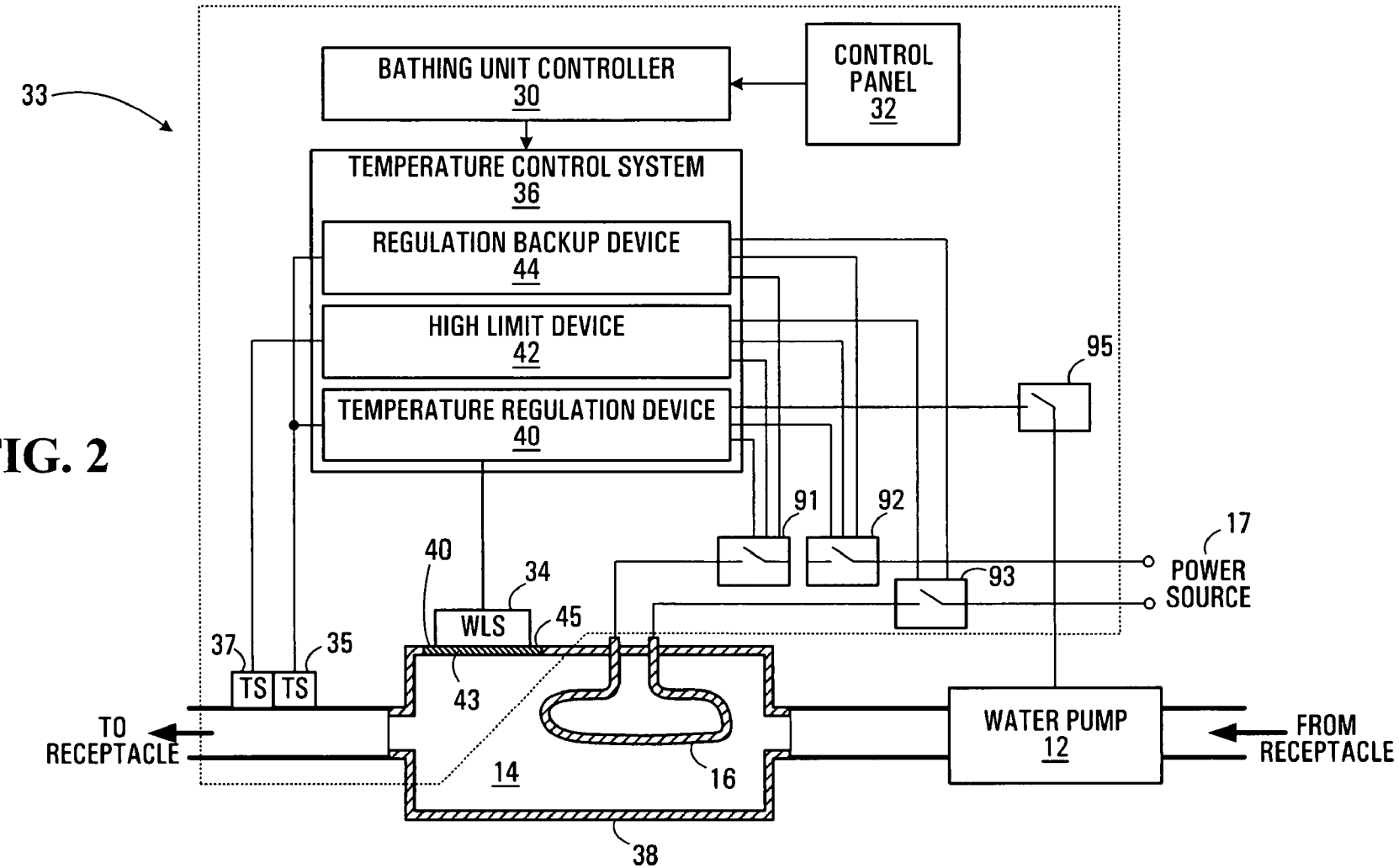
FIG. 2 shows a block diagram of a control system in communication with a heating module suitable for use with a bathing unit system in accordance with a non-limiting example of implementation of the present invention.

Referring now to FIG. 2, the temperature control system 36 and the heating module 14, are shown in greater detail. The heating module 14 includes a body 38 defining a passage through which water can flow, and an electric heating element 16 to transfer heat to the water flowing through the passage. The heating element 16 is powered by a suitable power source 17 such as a standard household electric circuit. It is to be understood that the water flow passage and heating element 16 can take various respective configurations without departing from the spirit and scope of the present invention. Also, the present invention could be adapted to a heating module 14 including other types of heating elements, such as a gas heater. In an alternative implementation, the heating element 16 includes heating surface components positioned on the outer and/or inner surfaces of the body 38 of the heating module and which are adapted to heat the water as it flows through the passage.

The body 38 of the heating module 14 can be formed of a conductive material or an electrically non-conductive material. In the case where the heating module 14 is in communication with a capacitive water level sensor, the body 38 of the heating module 14 includes an electrically non-conductive portion 40 having an inner surface 43 and an outer surface 45. The expression "electrically non-conductive material" refers to a class of materials having substantially low electrical conductivity properties such as plastics, elastomers, ceramics, and selected composite materials. Moreover, the body 38 of the heating module 14 may include a plurality of electrically non-conductive portions, or may be made entirely of such electrically non-conductive materials. In a specific practical implementation, the body 38 of the heating module also comprises one or more conductive parts for providing an electrical path between the water in the heating module 14 and ground.

The temperature control system 36 includes a temperature regulation device 40 and a regulation backup device 44, that are both in communication with a temperature sensor 35 located within the circulation piping between the heating module 14 and the water receptacle 18. In addition, the temperature control system 36 includes a high limit device 42 that is in communication with a different temperature sensor 37. The fact that the temperature sensor 37 is different than the temperature sensor 35, provides an additional security feature required by the UL standard. In the non-limiting embodiment shown in FIGS. 1 and 2, the temperature sensors 35 and 37 are located in the circulation piping just beyond the heating module 14. It should, however, be understood that the temperature sensors 35 and 37 can be positioned in other locations within the circulation piping, or within the heating module 14, without detracting from the spirit of the invention.

In addition, the temperature control system 36 includes three actuators 91, 92 and 93 that are associated with the heating module 14 and that are operative for causing the heating module 14 to acquire one of a heating state and a non-heating state. Each of the temperature regulation device 40, the high limit device 42 and the regulation backup device 44 are operative for controlling at least one of the actuators 91, 92 and 93. As shown, the temperature regulation device 40 is operative for controlling actuators 91 and 92 for causing the heating module 14 to acquire one of the heating state and the non-heating state. Some non-limiting examples of actuators suitable for being controlled by the temperature regulation device 40 include relays, switches and/or solid state devices, such as TRIACS, MOSFETs etc.

As will be described in more detail below, in normal operation it is the temperature regulation device 40 that is operative for maintaining the water temperature in the water receptacle 18 within a certain temperature range associated to a desired water temperature. The desired water temperature can be a predefined temperature that is stored in a memory of the temperature regulation device 40, or alternatively, the desired water temperature can be a temperature entered by a bather via the control panel 32. In the case where the desired water temperature is entered by a bather, it is stored in a memory unit of the bathing unit controller 30 and transmitted to the temperature regulation device 40, upon request. Preferably, the desired water temperature is between 38 and 41° C. Generally, the certain temperature range associated with the desired water temperature is referred to as the set point range, and is within a few degrees of the desired water temperature. For example, the certain temperature range may be ±1° C. from the desired water temperature. For the sake of example, let us assume that a bather entered the desired temperature of 40° C. As such, the certain temperature range might be from 39° C. to 41° C.

Since it is the temperature regulation device 40 that is responsible for maintaining the water temperature within the certain temperature range during normal operation, the high limit device 42 and the regulation backup device 44 are hardly ever used. Instead, the high limit device 42 and the regulation backup device 44 act as backup safety devices that are enabled when the temperature regulation device 40, or the actuators 91 and 92 that are controlled by the temperature regulation device 40, cease to function properly. As such, the high limit device 42 and the regulation backup device 44 ensure that the water temperature in the water receptacle 18 remains at a safe temperature in the case of a malfunction of either the temperature regulation device 40 or the actuators 91 and 92. The functionality of the high limit device 42 and the regulation backup device 44 will be described in more detail further on in the specification.

As mentioned above, the temperature regulation device 40 is operative for controlling a plurality of actuators 91 and 92 in order to cause the heating module 14 to acquire one of a heating state and a non-heating state. When the water in the water receptacle 18 reaches the lower limit of the certain temperature range, the temperature regulation device 40 controls the plurality of actuators so as to cause the heating module 14 to acquire a heating state. Conversely, when the water in the water receptacle 18 reaches the upper limit of the certain temperature range, the temperature regulation device 40 controls the plurality of actuators so as to cause the heating module 14 to acquire a non-heating state. In this manner, the temperature regulation device 40 is able to keep the water temperature within the certain temperature range associated to the desired water temperature.

Figure 3:
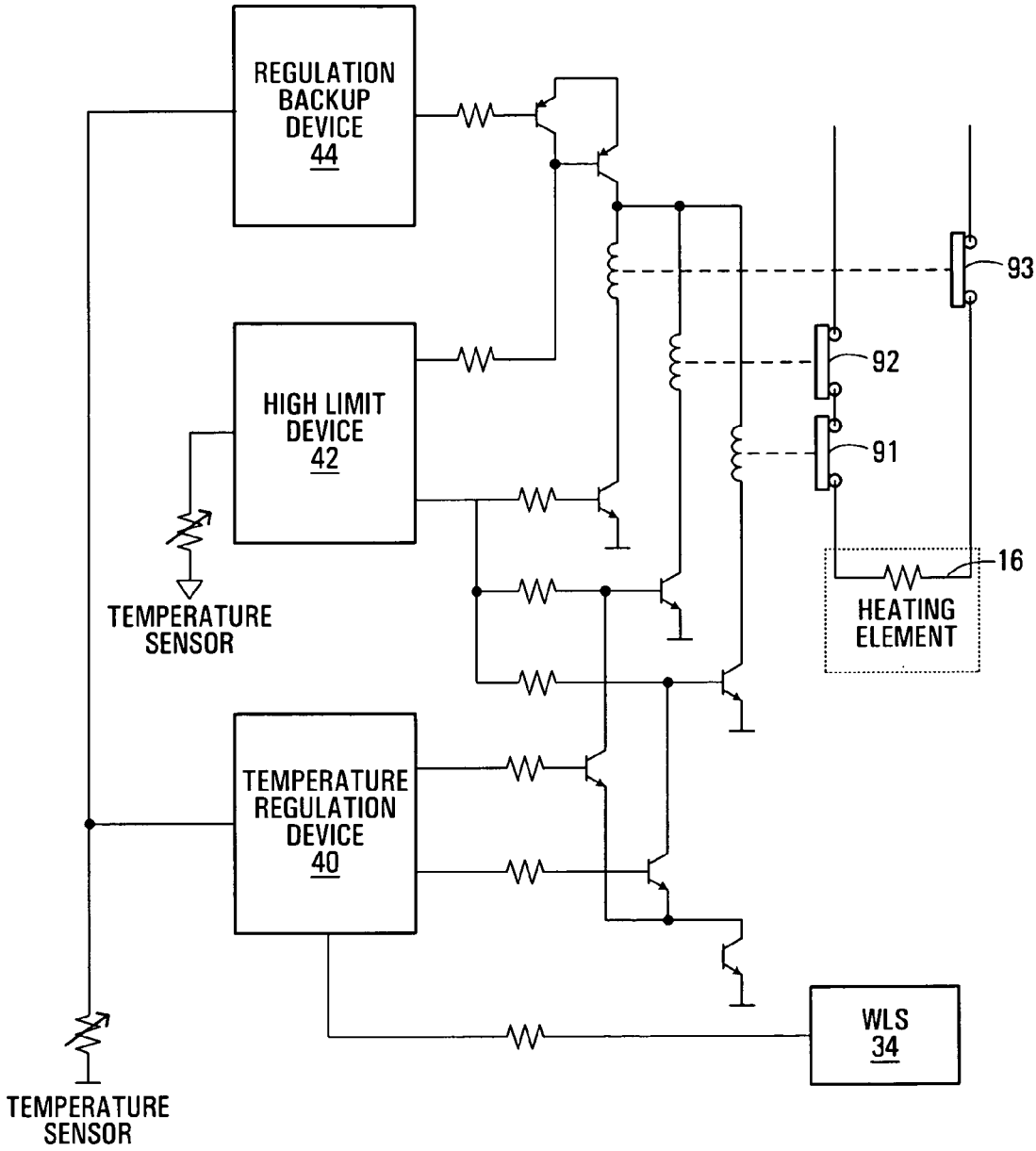
FIG. 3 shows a circuit diagram of a temperature control system in accordance with a non-limiting example of implementation of the present invention.

Shown in FIG. 3 is a circuit diagram of the temperature control system 36 in accordance with a non-limiting embodiment of the present invention. The temperature regulation device 40 is operative for controlling the plurality of the actuators 91 and 92 for causing the heating module 14 to acquire one of the heating state and the non-heating state. More specifically, when the water temperature in the water receptacle 18 has reached the lower limit of the certain temperature range, the temperature regulation device 40 is operative for controlling the plurality of actuators 91 and 92 for causing the heating module 14 to acquire a heating state, and when the water temperature in the water receptacle 18 has reached the upper limit of the certain temperature range, the temperature regulation device 40 is operative for controlling the plurality of actuators 91 and 92 for causing the heating module 14 to acquire a non-heating state.

In the non-limiting embodiment shown in FIG. 3, the actuators 91, 92 and 93 are relays and are connected in series. As such, when all three relays are closed, the heating module 14 is in a heating state and when one or more of the relays is open, the heating module 14 is in a non-heating state. During normal operation of the temperature regulation device 40, the actuator 93, which is operative to be controlled by the high limit device 42 and the regulation backup device 44 is generally closed. As such, it is the actuators 91 and 92 that are operative for acquiring various positions for causing the heating module to acquire one of the heating state and the non-heating state. More specifically, the plurality of actuators 91 and 92 are operative to acquire a first set of actuation patterns for causing the heating module to be in a non-heating state and a second set of actuation patterns for causing the heating module 14 to be in a heating state. The first set of actuation patterns can include at least two configurations for causing the heating module 14 to be in a non-heating state. For example, a first configuration could be when the actuator 91 is open and the actuator 92 is closed, and a second configuration could be when the actuator 91 is closed and the actuator 92 is open. The second set of actuation patterns includes at least one configuration for causing the heating module 14 to be in a heating state. For example, a configuration could be when both the actuator 91 and the actuator 92 are closed.

Since the temperature regulation device 40 is operative to control both actuators 91 and 92, by alternately opening actuators 91 and 92, to cause the non-heating state to be acquired, each of the actuators will be used half the amount of time, as compared to the case where the temperature regulation device 40 only controls one actuator for causing the heating module to acquire the non-heating state. As such, the lifetime of the two actuators 91 and 92 is effectively doubled.

Although FIG. 3 shows only three actuators 91, 92 and 93 associated to the heating module 14, and only two actuators that are able to be controlled by the temperature regulation device 40, it should be understood that more than three actuators can be associated to the heating module 14, and that more than two actuators can be controlled by the temperature regulation device 40, without departing from the spirit of the invention.

For example, in the case where there are N actuators associated to the heating module 14, each actuator is used 1/N of the time, assuming that the temperature regulation device 40 controls the N actuators such that they are used an equal amount of the time.

Figure 4:
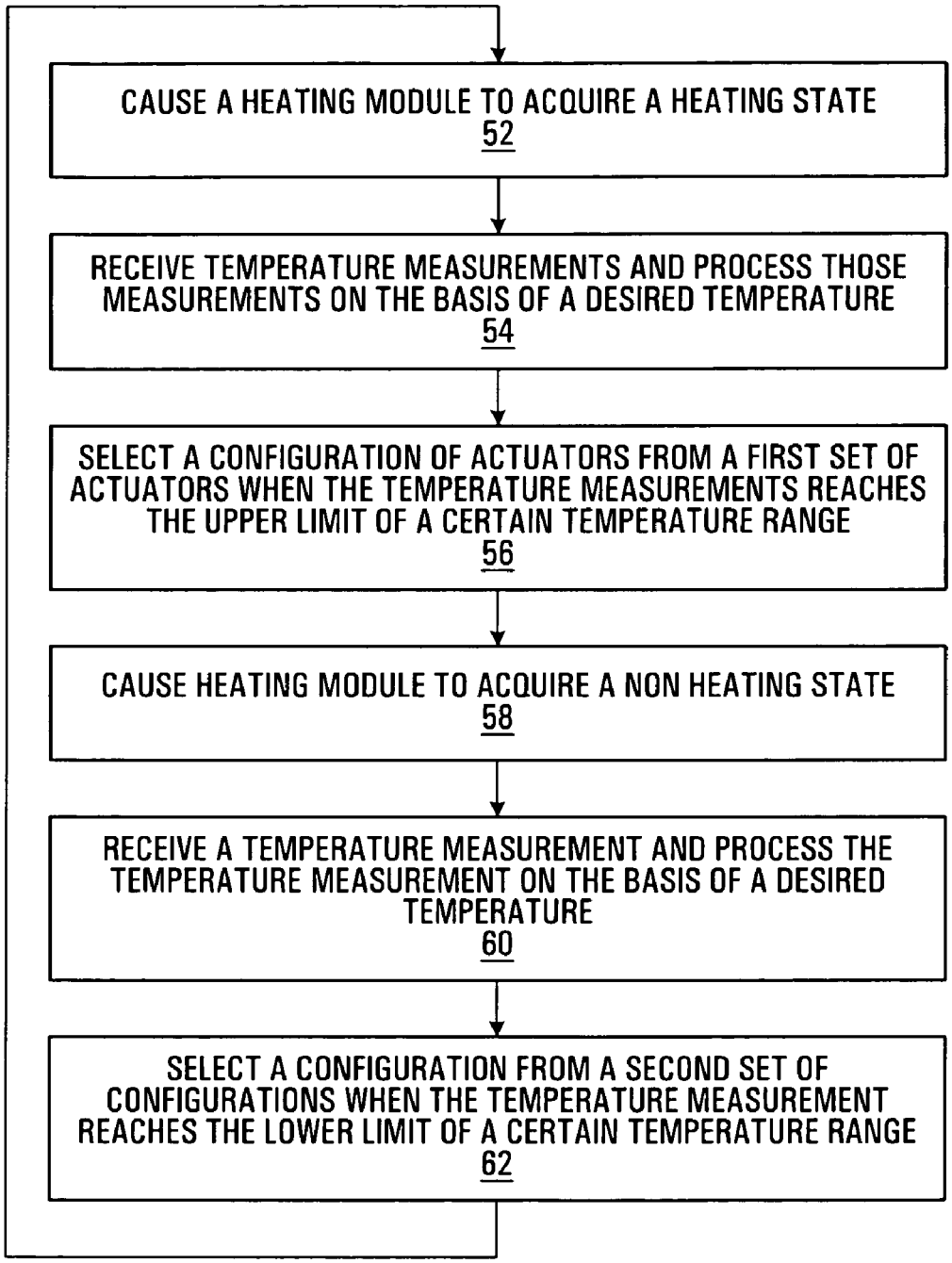
FIG. 4 shows a flow diagram of a method for maintaining the water temperature in a bathing unit within a certain temperature range in accordance with a non-limiting example of implementation of the present invention.

A non-limiting example of a process used by the temperature regulation device 40 for regulating the water temperature in the receptacle will now be described in more detail with respect to the flow chart shown in FIG. 4. Firstly, at step 52 the temperature regulation device 40 causes the heating module 14 to acquire a heating state. This can take place automatically upon powering up the temperature regulation device 40. At step 54, once the heating module 14 has been activated, the temperature regulation device 40 processes signals received from the temperature sensor 35 conveying the water temperature, at least in part on the basis of a desired water temperature. More specifically, the temperature regulation device 40 processes the signal indicative of the water temperature to determine if it has reached an upper limit of a certain temperature range associated to the desired temperature. Determining whether the water temperature has reached the upper limit of the certain temperature range can be performed in a variety of manners. In a first non-limiting example, the temperature regulation device 40 can determine whether the water temperature has reached the upper limit of the certain temperature range when the water temperature is equivalent to or greater than the temperature value of the upper limit of the temperature range. In keeping with the example described above, in the case where the temperature range is between 39 and 41° C., with the desired temperature being 40° C., the temperature regulation device 40 will determine that the water temperature has reached the upper limit of the certain temperature range, when the water temperature reading is indicative that the water temperature is 41° C. or greater. In a second non-limiting embodiment, the temperature regulation device 40 can determine that the water temperature has reached the upper limit of the certain temperature range when the water temperature exceeds the desired temperature. As such, when the water temperature reading conveys a water temperature above 40° C. the temperature regulation device 40 will determine that the water temperature has reached the upper limit of the certain temperature range.

At step 56, once the signal received from the temperature sensor 35 indicates that the water temperature has reached an upper limit of the certain temperature range, the temperature regulation device 40 selects a configuration for the plurality of actuators 91 and 92 from the first set of actuation patterns. As described above, the configurations in the first set of actuation patterns are adapted for causing the heating module to acquire a non-heating state.

It should be appreciated that there are a variety of ways for the temperature regulation device 40 to select a configuration from the first set of actuation patterns for causing the heating module to acquire a non-heating state. For example, the temperature regulation device 40 can select a configuration from the first set of actuation patterns on the basis of a pointer in a data structure containing the set of possible configurations. The pointer serves as an indication of which one of the configurations in the set to use next. The set of actuation patterns may be organized in any suitable data structure, such as a circular buffer data structure, for example. This buffer is used with a pointer indicating the next configuration to be used. With the circular buffer, every time a configuration is selected, the pointer is displaced to the next configuration in the circular buffer, such that the configurations are used in a sequential order.

In an alternative embodiment, the temperature regulation device 40 can select a configuration from the first set of actuation patterns contained in a data structure on the basis of a predetermined pattern. The predetermined pattern may use all the configurations in the first set of actuation patterns uniformly, or the predetermined pattern may use some actuators more often than others. For example, the pattern may cause a configuration A to be used 75% of the time, a configuration B to be used 20% of the time, and a configuration C to be used 5% of the time.

In yet another alternative embodiment, the temperature regulation device 40 can select a configuration from the set of actuation patterns randomly. The random selection can be generated by a pseudo-random number generator, for example. Pseudo-random number generators are known in the art, and as such will not be described in more detail herein.

At step 58, once the temperature regulation device 40 has selected a configuration from the first set of actuation patterns, the temperature regulation device 40 derives a control signal for causing the actuators to acquire the selected configuration. As such, at step 58 the heating module 14 is caused to acquire the non-heating state. In this fashion, the heating module 14 is disabled (or turned "OFF").

At step 60, once the heating module 14 is in the non-heating state, the temperature regulation device 40 receives a signal conveying the water temperature from the temperature sensor 35 and processes the signal at least in part on the basis of a desired temperature. More specifically, the temperature regulation module 40 processes the signal indicative of the water temperature to determine if it has reached or fallen below a lower limit of a certain temperature range associated to the desired temperature. Determining whether the water temperature has reached or fallen below the lower limit of the certain temperature range can be performed in a variety of manners, similar to those described above with respect to determining whether the water temperature has reached an upper limit of the certain temperature range.

At step 62, once the signal received from the temperature sensor 35 is indicative that the water temperature has reached or fallen below a lower limit of a certain temperature range, the temperature regulation device 40 selects a configuration for the plurality of actuators 91 and 92 from the second set of actuation patterns. As mentioned above, the configurations in the second set of actuation patterns are adapted for causing the heating module to acquire a heating state. The selection from the second set of actuation patterns may be effected in a manner similar to the selection for the first set of actuation patterns.

Once the temperature regulation device 40 has selected a configuration from the second set of actuation patterns, the temperature regulation device 40 derives a control signal for causing the actuators to acquire the selected configuration, and the temperature regulation device 40 returns to step 52, wherein the heating module 14 is caused to acquire the heating state. In this fashion, the process returns to step 52 wherein the heating module 14 is activated (or turned "ON").

Based on the above description of the process used by the temperature regulation device 40 to regulate the water temperature, it should be noticed that when the heating module 14 is in the heating state, the temperature regulation device 40 monitors the temperature of the water such that when the water temperature approaches or exceeds the upper limit of a certain temperature range, the heating module 14 is caused to acquire a non-heating state. Likewise, when the heating module 14 is in the non-heating state, the temperature regulation device 40 monitors the temperature of the water such that when the water temperature approaches or falls below the lower limit of the certain temperature range, the heating module is caused to acquire a heating state. This can best be shown with reference to FIG. 5*a*, which depicts in graphical form the normal operation of the temperature regulation device 40.

Figure 5A:
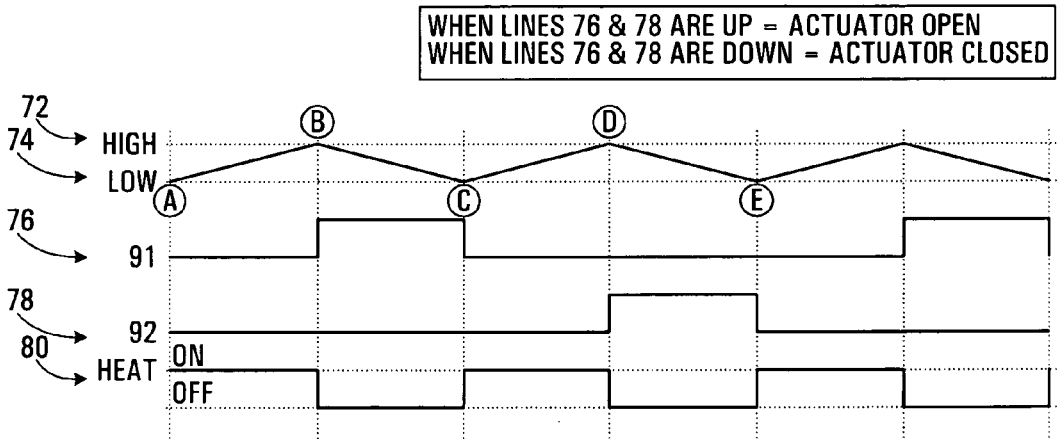
FIGS. 5A–5C show graphs representative of the regulation of the water temperature within a bathing unit under various conditions, in accordance with a non-limiting example of implementation of the present invention.

With reference to the graph shown in FIG. 5*a*, dashed line 72 represents the upper limit of a certain temperature range associated to the desired temperature, and dashed line 74 represents the lower limit of the certain temperature range. In addition, line 76 represents a control signal relating to the activation and the de-activation of actuator 91, line 78 represents a control signal relating to the activation and the de-activation of actuator 92 and line 80 represents the state of the heating module 14, namely whether the heating module is in a heating state or a non-heating state. As indicated in the legend positioned next to FIGS. 5A, 5B and 5C, when lines 76, 78 and 80 are in the up position, it means that the component is in the activated state. As such, for lines 76 and 78 the "up" position means that the respective actuators 91 and 92 receives a control signal for being activated and for line 80, the "up" position means that the heating module 14 is in the heating state.

Figure 5B:
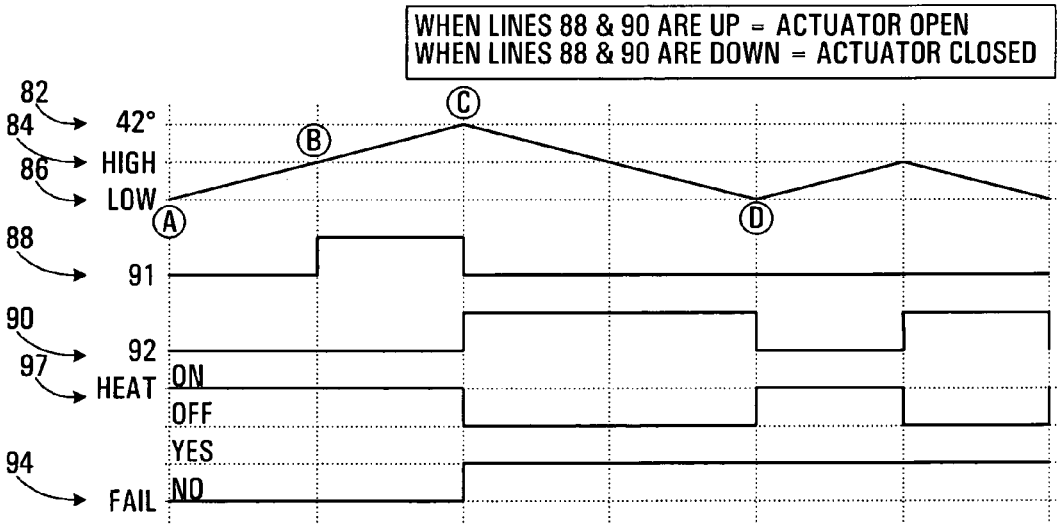
Figure 5C:
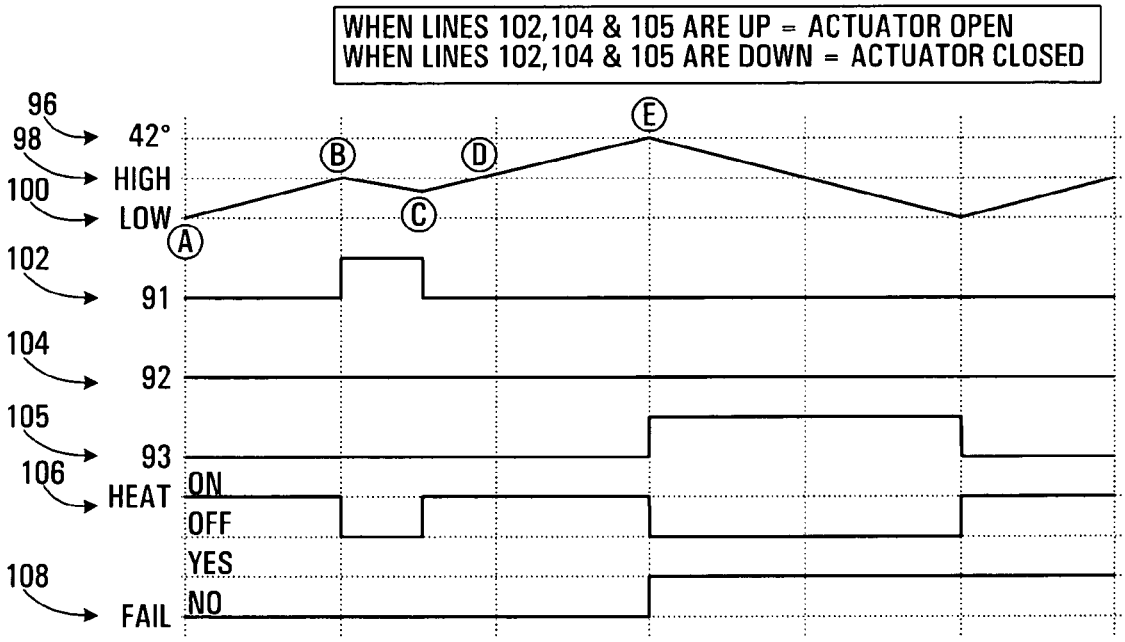

It should be understood that in the non-limiting embodiment described herein with respect to FIGS. 5A–5C, the default position for the actuators 91 and 92 is in the closed position, such that when the actuators 91 and 92 are in the default position, the heating module 14 is in the heating state. As such, when the actuators are deactivated, they are in the closed position. When the actuators are activated, they move into the open position, which causes the heating module 14 to be in the non-heating state.

In an alternative non-limiting embodiment, the default position for the actuators 91 and 92 could be in the open position, such that when the actuators 91 and 92 are in the default position, the heating module 14 is in the non-heating state. In such an embodiment, when the actuators 91 and 92 are activated, the actuators move into the closed position, wherein the heating module is in the heating state. Conversely, when one or more of the actuators 91 and 92 is deactivated, that actuator is in the default open position and the heating module 14 is in the non-heating state.

Referring back to FIG. 5A, in position A, both actuators 91 and 92 are in the closed position, as shown by lines 76 and 78, and as such the heating module 14 is in the heating state, as shown by line 80. At position B, the temperature regulation device 40 detects on the basis of a signal from the temperature sensor 35, that the water temperature has reached or exceeded the upper limit of the temperature range. Accordingly, and as indicated by lines 76 and 78, the temperature regulation device 40 selects a configuration for the plurality of actuators 91 and 92 from the first set of actuation patterns. In the non-limiting example shown, the configuration selected involves the actuator 91 being activated (or opened). As indicated by line 80, the fact that actuator 91 is opened causes the heating module 14 to be in a non-heating state, which in turn causes the water in the water receptacle 18 to cool down in the absence of a source of heat.

At position C, the temperature regulation device 40 detects on the basis of a signal from the temperature sensor 35, that the water temperature has reached or fallen below the lower limit of the temperature range. Accordingly, and as indicated by lines 76 and 78, the temperature regulation device 40 selects a configuration for the plurality of actuators 91 and 92 from the second set of actuation patterns. In the non-limiting example shown, the configuration selected involves both actuators 91 and 92 being in their closed position. As indicated by line 80, the fact that actuators 91 and 92 are in their closed position causes the heating module 14 to be in a heating state, which in turn causes the water in the water receptacle 18 to start to heat up.

At position D, the temperature regulation device 40 once again detects on the basis of a signal from the temperature sensor 35, that the water temperature has reached or exceeded the upper limit of the temperature range. Accordingly, the temperature regulation device 40 selects a configuration for the plurality of actuators 91 and 92 from the first set of actuation patterns. However, this time, as indicated by lines 76 and 78, the configuration selected by the temperature regulation device 40 involves the actuator 92 being opened. As such, the fact that actuator 92 is opened causes the heating module 14 to be in a non-heating state, which in turn causes the water in the water receptacle 18 to cool down.

At position E, the temperature regulation device 40 determines once again that the water temperature has reached the lower limit of the temperature range, and selects a configuration for the actuators 91 and 92 for causing the heating module 14 to acquire the heating state. The process described with respect to positions A through E is then continually repeated in order to maintain the water temperature within the certain temperature range.

As described above, the temperature control system 36 includes a high-limit device 42 and a regulation backup device 44 that are adapted for causing the heating module 14 to acquire the non-heating state upon detection of a malfunction of the temperature regulation device 40, or upon detection of a malfunction of one of the plurality of actuators 91 and 92 controlled by the temperature regulation device 40. As shown in the non-limiting implementation of FIG. 3, the regulation backup device 44 is operative for controlling all of actuators 91, 92 and 93, and the regulation back-up device is operative for controlling actuator 93. As such, both of the high-limit device 42 and the regulation backup device 44 are adapted for causing the heating module 14 to acquire a non-heating state, in the case where the temperature regulation device 40 malfunctions.

The regulation backup device 44 is operative for ensuring that the water temperature in the water receptacle 18 does not exceed a first threshold above the certain temperature range. As such, when the water temperature reaches the first threshold above the certain temperature range, the regulation backup device opens at least one of the actuators 91, 92 and 93, for causing the heating module 14 to acquire the non-heating state. In the non-limiting example of implementation that will be described herein, the regulation backup device 44 is operative for ensuring that the water temperature in the water receptacle 18 does not exceed a first threshold value of 42° C.

The high limit device 42 is operative for ensuring that the water temperature in the water receptacle 18 does not exceed a second threshold temperature that is above the first threshold temperature. Once the water temperature reaches or exceeds the second threshold temperature, the high limit device 42 activates at least one of the actuators 91, 92 and 93, for causing the heating module 14 to acquire the non-heating state. In the non-limiting example of implementation that will be described herein, the high limit device 42 is operative for ensuring that the water temperature in the water receptacle 18 does not exceed a value of 50° C.

It should be noted that at least one of the regulation backup device 44 and the high limit device 42 is operative to control at least one actuator that is distinct from the plurality of actuators that are adapted for being controlled by the temperature regulation device 40. In the non-limiting embodiment shown in FIG. 2, both the regulation backup device 44 and the high-limit device 42 are operative for controlling actuator 93, which is distinct from the plurality of actuators 91 and 92 adapted for being controlled by the temperature regulation device 40. In the non-limiting example shown in FIGS. 2 and 3, the regulation backup device 44 is operative for controlling, and causing the deactivation of all actuators 91, 92 and 93, in the case of a problem with the temperature regulation device 40.

Shown in FIG. 5B is a graphical depiction of the operation of the temperature control system 36 when actuator 91 fails to open. The dashed line 82 represents the temperature value at which the regulation backup device 44 causes the heating module 14 to acquire the non-heating state. The dashed lines 84 and 86 represent the upper limit and lower limit respectively, of a certain temperature range associated to the desired temperature. Line 88 represents a control signal for causing the activation and deactivation of actuator 91, line 90 represents a control signal for causing the activation and deactivation of actuator 92 and line 97 represents the state of the heating module 14. Finally, line 94 represents when the temperature control system 36 is in a state of failure.

In position A, both actuators 91 and 92 are in the default closed position, as shown by lines 88 and 90, and as such the heating module 14 is in the heating state, as shown by line 97. At position B, the temperature regulation device 40 detects on the basis of a signal from the temperature sensor 35, that the water temperature has reached or exceeded the upper limit of the temperature range. Accordingly, and as indicated by lines 88 and 90, the temperature regulation device 40 selects a configuration for the plurality of actuators 91 and 92 from the first set of actuation patterns. In the non-limiting example shown, the configuration selected involves the actuator 91 being open and actuator 92 being closed. Although the temperature regulation device 40 has issued a control signal for causing the activation of actuator 91, meaning that it should acquire the open configuration, as indicated by line 97, the heating module 14 is still in a heating state. This means that although the temperature regulation device 40 has sent a signal to actuator 91 that it should open, the actuator 91, or the circuit of the actuator, has malfunctioned, and not opened. As such, the water in the water receptacle 18 continues to heat up, thereby exceeding the upper limit of the temperature range associated to the desired temperature.

At position C, the regulation backup device 44 detects on the basis of a signal from the temperature sensor 35, that the water temperature has reached or exceeded the value of 42° C. It is at position C that the temperature regulation device 40 determines that there has been a failure, as shown by line 94. In response, the regulation backup device 44 derives a control signal for causing the actuators 91, 92 and 93 to acquire a configuration for causing the heating module 14 to acquire a non-heating state.

Accordingly, and as indicated by line 90, the regulation backup device 44, upon determining that actuator 91 may be defective, causes one of the remaining actuators 92 and 93 to be opened, thereby causing the heating module 14 to acquire the non-heating state. In the non-limiting example shown, the configuration selected involves actuator 92 being opened. As indicated by line 97, the fact that actuator 92 is activated, and therefore open, causes the heating module 14 to be in a non-heating state, which in turn causes the water in the water receptacle 18 to start to cool down.

At position D, the temperature regulation device 40 detects on the basis of a signal from the temperature sensor 35, that the water temperature has reached or fallen below the lower limit of the certain temperature range. Accordingly, the temperature regulation device 40 causes actuator 92 to be closed, such that the heating module 14 acquires the heating state. In this manner, the water in the water receptacle 18 starts to heat up. Since the temperature regulation device 40 has been informed that actuator 91 has failed, and is unable to open, the temperature regulation device 40 is able to regain control of maintaining the water temperature within the certain temperature range by using only actuator 92.

Shown in FIG. 5C is a graphical depiction of the operation of the temperature control system 36 when both actuators 91 and 92 continue to operate properly, but the temperature regulation device 40 itself malfunctions. The dashed line 96 represents the temperature value at which the regulation backup device 44 causes the heating module 14 to acquire the non-heating state. The dashed lines 98 and 100 represent the upper limit and lower limit, respectively, of a certain temperature range associated to the desired temperature. In addition, line 102 represents a control signal for causing the activation and de-activation of actuator 91, line 104 represents a control signal for causing the activation and de-activation of actuator 92, and line 106 represents the state of heating module 14. Finally, line 108 represents when the temperature control system 10 is in a state of failure.

In position A, both actuators 91 and 92 are in the closed position, as shown by lines 102 and 104, and as such the heating module 14 is in the heating state, as shown by line 106. At position B, the temperature regulation device 40 detects on the basis of a signal from the temperature sensor 35, that the water temperature has reached or exceeded the upper limit of the certain temperature range. Accordingly, and as indicated by lines 102 and 104, the temperature regulation device 40 selects a configuration for the plurality of actuators 91 and 92 from the first set of actuation patterns. In the non-limiting example shown, the configuration selected involves the actuator 91 being opened, thereby causing the heating module 14 to be in a non-heating state, as indicated by line 106. As such, the water in the water receptacle 18 starts to cool down in the absence of a heat source.

At position C, the temperature regulation device 40 malfunctions and ceases to issue a control signal for causing the activation of actuator 91. Accordingly, the actuator 91 returns to its default position wherein the heating module 14 acquires the heating state, as shown by line 106. As such, the water in the water receptacle 18 begins to heat up.

At position D, the temperature regulation device 40 detects, on the basis of a signal from the temperature sensor 35, that the water temperature has reached or exceeded the upper limit of the temperature range. However, since the temperature regulation device 40 is malfunctioning, the temperature regulation device 40 either does not receive the signal from the temperature sensor 35, or is unable to process the signal in order to derive a control signal for causing the heating module 14 to acquire the non-heating state. As such, the heating module 14 remains in the heating state, as indicated by line 106, and the water temperature continues to heat up.

At position E, the regulation backup device 44, on the basis of a signal from the temperature sensor 35, detects that the water temperature has reached or exceeded the value of 42° C. It is at this point that the regulation backup device 44 derives a control signal for causing the actuators to acquire a configuration for causing the heating module 14 to acquire a non-heating state. In addition, as indicated by line 108, it is at this point that the temperature control system 36 determines that there has been a failure, as shown by line 108.

Furthermore, at position E, the regulation backup device 44 causes the actuator 93 to be opened, thereby causing the heating module 14 to acquire the non-heating state. As indicated by line 106, the fact that actuator 93 is activated, and therefore open, causes the heating module 14 to be in a non-heating state, which in turn causes the water in the water receptacle 18 to cool down.

It should be understood that in the cases described above with respect to FIGS. 5B and 5C that upon detection of a failure of the temperature control system 36, the failure can be communicated to a bather via a visual or audio signal. For example, the visual indication may be provided to a user via a console, or control panel, the bathing unit controller 30 or any other manner known in the art. In this manner, the temperature control system 36 can provide diagnostic information to the bather indicative of when and where the failure occurred.

In the description provided above, the temperature regulation device 40 has been described as processing the signal received from the temperature sensor 35 at least in part on the basis of a desired water temperature in order to derive a control signal for controlling the plurality of actuators 91 and 92. It should, however, be understood that in an alternative embodiment, the temperature regulation device 40 includes programming logic adapted for processing the signal received from the temperature sensor 35 in combination with other parameters as well. For example, in the non-limiting embodiment shown in FIG. 2, the temperature regulation device 40 is also in communication with the water level sensor 34. The water level sensor 34 can be any type of water level sensor for obtaining a reading of the water level in the heating module 14. In a non-limiting embodiment, the water level sensor 34 is a capacitive water level sensor 34 adapted for obtaining a capacitance measurement associated to a level of water in the heating module 14.

As such, in a non-limiting embodiment, the temperature regulation device 40 is operative for deriving a second control signal at least in part on the basis of the capacitance measurement associated to a level of water in the heating module 14 and controlling the plurality of actuators at least in part on the basis of that second control signal. For example, if the capacitance measurement is indicative that there is a low level of water in the heating module 14 then the temperature regulation device 40 may derive a control signal for causing the heating module to either acquire the non-heating state or remain in the non-heating state, so as not to cause damage to any of the components of the heating module 14.

Figure 10:
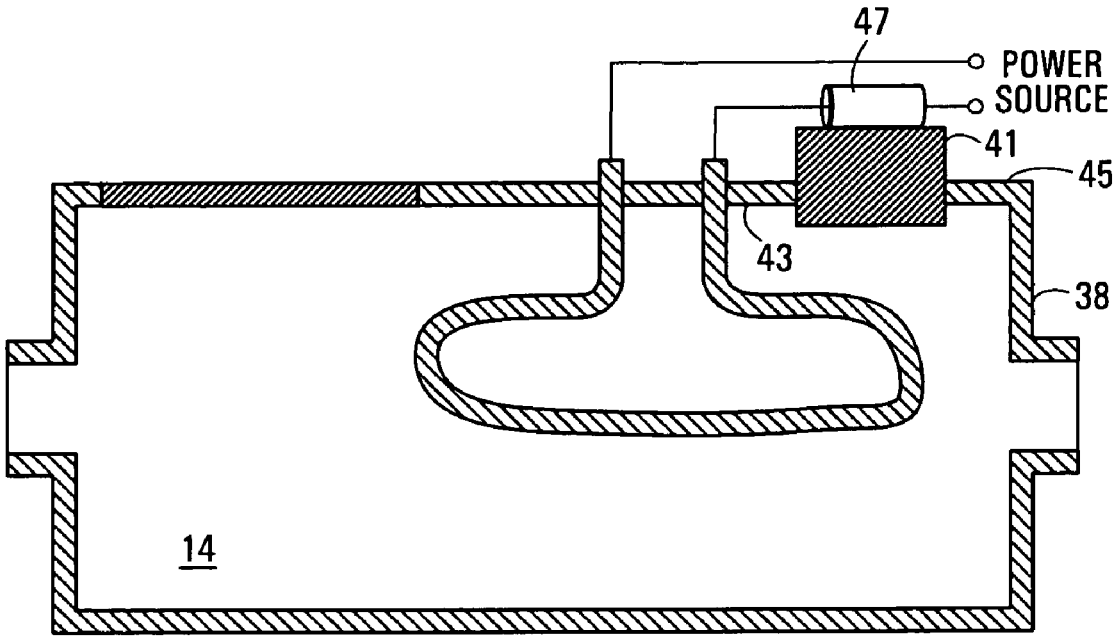
FIG. 10 shows a heating module with a solid state controller mounted thereto, in accordance with a non-limiting embodiment of the present invention.

In the non-limiting embodiment wherein the actuator used by the temperature regulation device 40 to control the heating module 14 is a solid state device, the solid state device must be sufficiently cooled in order to maintain its operating properties. Cooling of a solid state device is typically achieved through the use of a heat sink. In a specific implementation, the water in the bathing unit is used for providing a heat sink to cool the solid state device. In a specific non-limiting implementation, the body 38 of the heating module 14, or a portion of the piping through which the water circulates, includes a thermally conductive portion 41 on which is mounted the solid state device. This thermally conductive portion provides a thermal coupling between the solid state device and the water such that the solid state device is cooled by the water circulating through the heating module 14 or piping. In the non-limiting embodiment shown in FIG. 10, the thermally conductive portion 41 extends from the inner surface 43 of the body 38, to the outer surface 45 of the body 38, such that it is in contact with the water within the heating module 14. More specifically, the solid state device 47 is mounted to the outer surface 45 of the body 38, such that it is in contact with the thermally conductive portion 41 of the heating module 14. As such, the thermally conductive portion 41 of the heating module 14 and the water contained therein act as a heat sink for the solid state device 47, and causes the solid state device 47 to be cooled by the temperature of the water. As such, the thermally conductive portion 41 keeps the solid state device 47 cool during use. It should be understood that the solid state device 47 can be mounted to the outer surface 45 of the heating module 14, such that it is in contact with the thermally conductive portion 41, in any manner known in the art, such as by adhesive or mechanical fasteners, such as compression brackets, for example. In a non-limiting example of implementation, the solid state device 47 is mounted to the outer surface 45 of the heating module 14 by one or more compression brackets.

Controlling the heating module 14 via a solid state device 41 provides a benefit of being able to control the amount of power supplied to the heating module 14, and as such the amount of energy generated by the heating module 14. Therefore, once the water temperature in the bathing unit has reached a desired temperature, the solid state device 41 can reduce the amount of energy generated by the heating module 14 in order to maintain the water temperature at the desired temperature. This is because less energy is required from the heating module 14 to keep the water at the desired temperature, than to heat the water from a low temperature up to the desired temperature. For example, the properties of the solid state device 41 may be used for activating the heating module 14 a fraction of the time such that the heating module 14 is used at 30% capacity, 50% capacity or 75% capacity, as desired.

Furthermore, by being able to control the power in the heating element 16 the overall power per square inch applied to the heating element 16 can be decreased, which will generally tend to increase the life span of the heating element. In a non-limiting embodiment of the present invention, wherein the solid state device is a TRIAC, the temperature regulation device 40 can control the amount of energy generated by the heating module 14 by controlling the TRIAC such that it is not in continuous operation. More specifically, the temperature regulation device 40 can send a pulse delay to trigger the TRIAC. The TRIAC can be triggered at any time during a 60 Hz (or 50 Hz) cycle to reduce the energy sent to the heating module 14. Alternatively, the TRIAC can skip a cycle by being triggered only every second, third or fourth 60 Hz cycle. By reducing the power supplied to the heating module 14, the lifetime of the electric element 16 can be lengthened.

This also applies to other suitable solid state devices that may be used. Such devices include, without being limited to: TRIACs, SCRs, FETs, IGBTs, MOSFETs, JFETs and BJT (bipolar junction transistors).

A further feature of controlling the heating module 14 via a solid state device 41 is that the solid state device 41 can be used such as to reduced current usage when less current is available. An example will better illustrate this feature. For example, in the case where a plurality of components of the bathing unit system 10 are being used, such as the air blower, the lights and the pump, such that the maximum amount of current available at the power source is close to being exceeded, the temperature regulation device 40 can alter the amount of current applied to the solid state device 41, such that the total amount of current available is not exceeded. As such, in the case where there is a reduced amount of current available, the heating module 14 does not need to be shut off altogether, since the amount of current applied to the solid state device 41 can be reduced. As such, even when the amount of current available is reduced, due to the fact that many components of the bathing unit system 10 are in operation, the heating element 16 is still able to provide a bit of heat to the water in the bathing unit. In addition, by activating the heating module by 30% of a 60 Hz cycle, less current is being used by the heating module. Consequently, where operating a heating module at full capacity (100%) would have required a certain amount of current, say 16 Amps, by using the solid state device to reduce the activating time of the heating module to 30% a lesser amount of current is required. When the current available to the bathing system is limited, this allows for the heating module to remain in operation even when less that 5 Amps is available.

Controlling the Water Pump 12

Referring back to FIG. 2, the temperature regulation device 40 is in communication with a water pump 12 and is operable for activating and deactivating the water pump 12. More specifically, the temperature regulation device 40 is operative for controlling an actuator 95 for causing the water pump 12 to be activated and deactivated. As described above, some non-limiting examples of actuators include relays, switches and TRIACs. In the non-limiting embodiment described herein, the actuator 95 is in the form of a relay.

When activated, the water pump 12 is operative to circulate the water between the water receptacle 18 and the heating module 14 through the circulation pipes. A first reason for circulating water between the water receptacle 18 and the heating module 14 is to cause the water from the water receptacle 18 to pass through the heating module 14 when the heating module 14 is in the heating state, so as to cause the water to be heated. A second reason for circulating the water is to attain a uniform water temperature in the water receptacle 18 and the heating module 14, in order to be able to obtain water temperature measurements that reflect the water temperature in the water receptacle 18. Often, once the water pump 12 has been de-active for a period of time, the water in the circulation piping and the heating module 14 will be at a different temperature than the water in the water receptacle 18. This could be because the water receptacle 18 is positioned in direct sunlight and the circulation piping and the heating module 14 are positioned under the water receptacle 18 in the shade. Since the temperature sensor 35 is in the circulation piping, it is desirable to circulate the water between the water receptacle 18 and the heating module 14 for a period of time prior to taking a temperature reading so as to ensure that the water temperature in the circulation piping and the water receptacle 18 is uniform.

In order to extend the lifetime of the water pump 12, and the actuator 95, and to reduce the power consumption of the bathing unit, it is desirable that the water pump 12 be deactivated when the heating module 14 is in the non-heating state. In addition, in order to avoid activating the water pump 12 too frequently, which decreases the lifespan of the water pump 12 and the actuator, it is desirable to optimize the delay time during which the water pump 12 is de-activated, such that the water pump 12 is deactivated for as long as possible without allowing the water temperature in the water receptacle 18 to decrease below the lower limit of the certain temperature range.

In accordance with a broad aspect, the process used by the temperature regulation device 40 includes intermittently causing activation of the water pump 12 to cause water to circulate between the water receptacle 18 and the heating module 14, wherein the re-activation of the water pump 12 occurs after a certain delay time from the deactivation of the water pump 12, and modifying the certain delay time at least in part on the basis of temperature measurements of the water taken between successive activations of the water pump 12.

Figure 6:
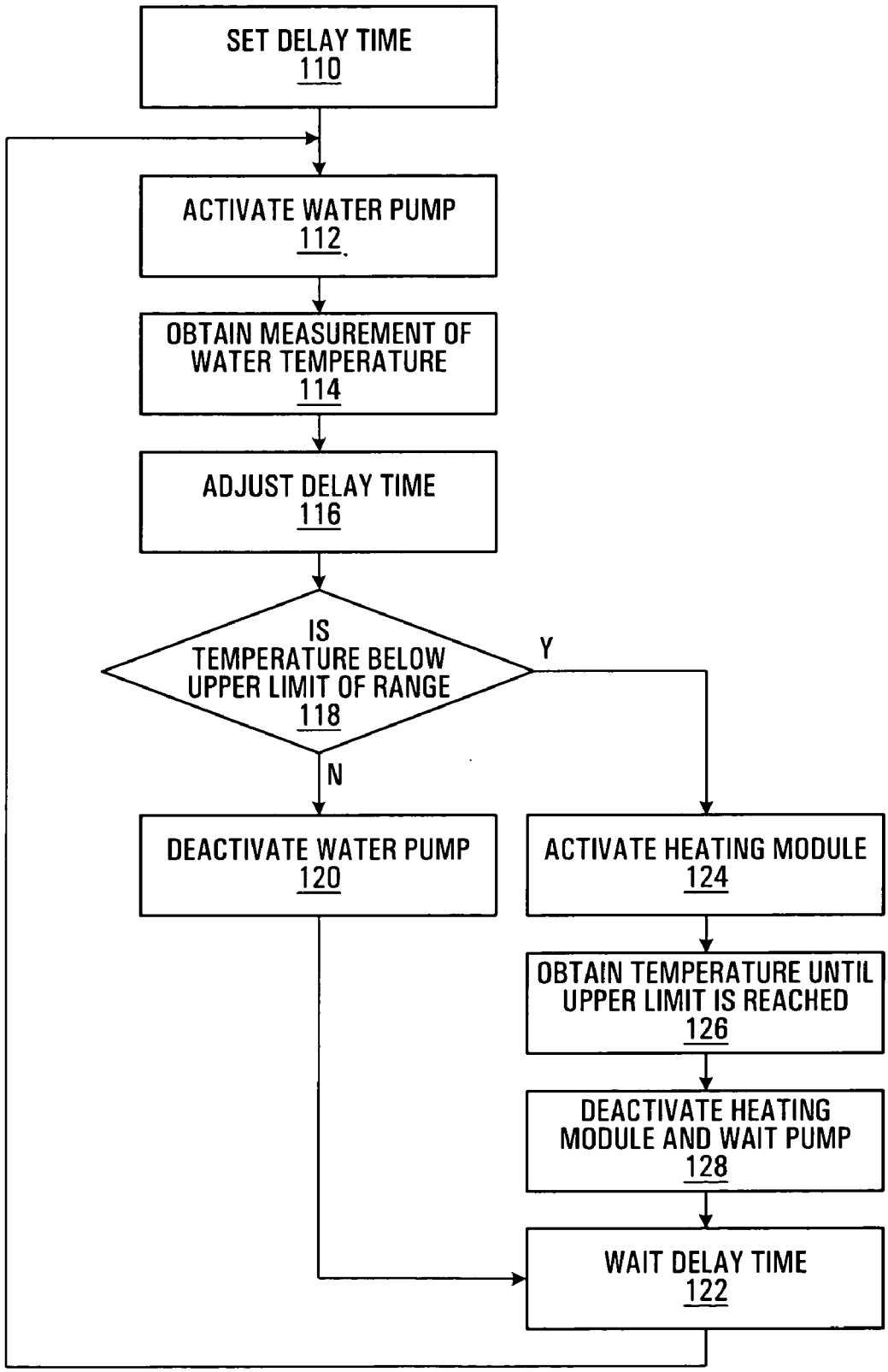
FIG. 6 shows a flow diagram of a method for calculating a delay time between the deactivation of a water pump and the re-activation of a water pump, in accordance with a non-limiting example of implementation of the present invention.

Shown in FIG. 6 is a non-limiting example of a process used by the temperature regulation device 40 for adjusting a delay time during which the water pump 12 should be de-activated. At step 110, the temperature regulation device 40 sets an initial delay time between the deactivation of the water pump 12 and a subsequent re-activation of the water pump 12. In a non-limiting embodiment, the initial delay time can be set at any time period, such as 30 minutes, for example. This initial delay time can either be a value stored in the memory of the temperature regulation system, such that each time the bathing unit system 10 is activated, the initial time delay will be the predetermined value (of say 30 minutes), or alternatively, the initial delay time can be entered by a bather via the control panel 32, or can be based on the last delay time used during the last use of the bathing unit.

At step 112, once the initial time delay has been set, the temperature regulation device 40 controls the actuator 95, shown in FIG. 2, for causing the water pump 12 to be activated. It should also be understood that in an alternative embodiment, it could be the bathing unit controller 30 that controls the actuator 95. Once the actuator causes the water pump 12 to be activated, water from the water receptacle 18 begins to circulate through the circulation piping and the heating module 14, which causes the water temperature within these components to become uniform. At step 114, once the water temperature has stabilized and become uniform, the temperature regulation device 40 processes a signal from the temperature sensor 35 indicative of the temperature of the water.

At step 116, the temperature regulation device 40 adjusts the delay time between a deactivation of the water pump 12, and a subsequent reactivation of the water pump 12. The first time the temperature regulation device 40 performs step 116, the temperature regulation device 40 will simply set the new delay time to be equivalent to the initial delay time that was established at step 110, as described above.

At step 118, once the temperature regulation device 40 has derived the new delay time, the temperature regulation device 40 processes the signal received from the temperature sensor 35 at step 114, in order to determine whether the water temperature is below the upper limit of the certain temperature range. Determining whether the water temperature is below the upper limit of the certain temperature range can be performed in a variety of manners. In a first non-limiting example, the temperature regulation device 40 can determine that the water temperature is below the upper limit of the certain temperature range, when the water temperature is below the temperature value of the upper limit of the temperature range. In keeping with the example described above, in the case where the temperature range is between 39 and 41° C., with the desired temperature being 40° C., the temperature regulation device 40 will determine that the water temperature is below the upper limit of the certain temperature range, when the water temperature reading is indicative that the water temperature is below 41° C. In a second non-limiting embodiment, the temperature regulation device 40 can determine that the water temperature is below the upper limit of the certain temperature range, when the water temperature falls below the desired temperature. As such, when the water temperature reading is indicative that the water temperature is anywhere below 40° C. the temperature regulation device 40 will determine that the water temperature is below the upper limit of the certain temperature range.

In the case where the water temperature has fallen below the upper limit of the certain temperature range, the temperature regulation device 40 proceeds to step 124 where the heating module 14 is caused to acquire the heating state. At step 126, the temperature regulation device 40 receives signals from the temperature sensor 35 indicative of the water temperature. The temperature regulation device 40 processes these signals in order to determine whether the water temperature has reached or exceeded the upper limit of the certain temperature range. Determining whether the water temperature has reached the upper limit of the certain temperature range can be performed in a variety of manners, similar to those described with respect to determining whether the water temperature is below the upper limit of the certain temperature range. Once the temperature regulation device 40 has determined that the water temperature has reached the upper limit of the certain temperature range, the temperature regulation device 40 proceeds to step 128 wherein the heating module 14 is caused to acquire the non-heating state, and the water pump 12 will be deactivated after a short delay (typically 30 seconds) to cool down the element.

Once the heating module 14 has acquired the non-heating state, and the water pump 12 has been deactivated, the temperature regulation device 40 waits until the delay time has elapsed before reactivating the water pump 12. During this delay time, the water in the water receptacle 18 generally decreases in temperature, given the absence of a heating source.

Once the delay time has elapsed, the temperature regulation device 40 returns to step 112, where it controls the actuator 95 for causing the water pump 12 to be activated. The activation of the water pump 12 causes the water in the water receptacle 18 to circulate through the circulation piping and the heating module 14 such that the water temperature in these components becomes uniform. Once again, at step 114, the temperature regulation device 40 processes a signal from the temperature sensor 35 indicative of the water temperature.

At step 116, the temperature regulation device 40 is able to re-calculate a new delay time. In a non-limiting example of implementation, the temperature regulation device 40 calculates the rate of temperature decrease on the basis of the temperature of the water obtained from the temperature sensor 35 at step 126, and the temperature of the water obtained from the temperature sensor 35 at step 114. The temperature of the water obtained at step 126 will be indicative of a temperature that is close to the upper limit of the certain temperature range, and the temperature of the water obtained at step 114 will usually be less than the temperature obtained at step 126.

In a non-limiting example, the rate of temperature decrease is calculated using the following formula:

$$\text{Rate of Temperature Decrease}=(T_{from\ step\ 126}-T_{from\ step\ 114})/\text{time}$$

On the basis of the rate of temperature decrease, the temperature regulation device 40 derives an estimated delay for time the water temperature to decrease from the upper limit of the certain temperature range, to the lower limit of the certain temperature range. Therefore, the time calculated by the temperature regulation device 40 at step 116 becomes the new delay time. In a non-limiting example, the new delay time can be calculated using the following formula:

$$\text{New delay Time}=(T_{upper\ limit}-T_{lower\ limit})/\text{Rate of Temperature Decrease}$$

At step 118, the temperature regulation device 40 further processes the temperature measurement obtained at step 114 in order to determine whether the water temperature fallen below the upper limit of the certain temperature range. In the case where the water temperature has not fallen below the upper limit of the certain temperature range, the temperature regulation device 40 proceeds to step 120 where it controls the actuator 95 for causing the water pump 12 to be deactivated.

The temperature regulation device 40, then proceeds to step 122 wherein it waits the time delay. After the time delay has elapsed, the temperature regulation device 40 returns to step 112 wherein it controls the actuator 95 for causing the water pump 12 to be re-activated. Once the temperature regulation device 40 has been through the above-described process one full cycle, it should have derived a fairly accurate delay time required for the water temperature to decrease from the upper limit of the certain temperature range, to the lower limit of the certain temperature range. As such, after the first pass through the process, the temperature regulation device 40 will usually proceed to step 124 from step 118. Therefore, step 116 of adjusting the delay time will simply be for the purpose of fine-tuning the exact delay time necessary. For example, as the sun goes down in the evening, the delay time between a deactivation of the water pump 12 and a subsequent re-activation of the water pump 12 might decrease, given that the water might need to be heated more frequently.

In parallel with the process described above, the ambient temperature of the air can be monitored by one of the bathing unit controller 30 or the temperature control system 36. In the non-limiting embodiment shown in FIG. 1, the bathing unit controller 30 is in communication with an ambient temperature sensor 39 for receiving signals indicative of the ambient temperature of the air. In non-limiting example of implementation, the ambient temperature sensor 39 is located inside the bathing unit controller 30 housing. It will be appreciated that the actual ambient temperature and the temperature inside the bathing unit controller housing may differ from one another. Optionally, in such an implementation, the ambient temperature sensor may be calibrated such as to include a temperature offset in order to allow the ambient temperature sensor to provide a more exact ambient temperature measurement. It should also be understood that in certain implementations it could be the temperature regulation device 40 that is in communication with the ambient temperature sensor 39.

In an alternative, non-limiting embodiment, instead of determining a new delay time on the basis of the water temperature in the water receptacle 18, the new delay time can be determined on the basis of the ambient air temperature measurement, which can be indicative of an air temperature, or a rate of increase/decrease of temperature. For example, in the case where the ambient air temperature changes rapidly, the bathing unit controller 42 can determine that there has been a rapid decrease, or increase, in ambient air temperature, and as such can determine a new delay time. In addition, in the case where the ambient air temperature decreases rapidly, the bathing unit controller 42 can automatically cause the water pump 12 to be re-activated prior to the expiry of the old delay time.

The new delay time can be determined at least in part on the basis of at least one of the ambient air temperature, the rate of air temperature decrease and the desired water temperature. In a non-limiting embodiment, this new delay time can be determined on the basis of a look-up table stored in the memory of either the bathing unit controller 30 or the temperature control system 36. The lookup table can include a list of ambient air temperatures, rates of air temperature decrease, desired water temperatures as well as corresponding delay times associated to those parameters.

In operation, the bathing unit controller 30 is operative for monitoring the signals received from the temperature sensor 39 indicative of the ambient air temperature. On the basis of these signals, the bathing unit controller 30 is operative for determining if the ambient air temperature is increasing or decreasing at a rapid rate. In the case where the bathing unit controller 30 determines that the ambient air temperature is decreasing at a rapid rate, such as by 10° C. during the course of the water pump 12 being deactivated, which let us assume is 30 minutes, the bathing unit controller 30 is operative for causing the water pump 12 to be reactivated, and for determining a new delay time during which the water pump 12 should be deactivated. As mentioned above, in order to determine the new delay time, the bathing unit controller 30 can perform a look-up operation in a table stored in its memory. Let us assume for the sake of example that the look-up table includes a list of rates of ambient air temperature decrease associated with new delay times. Therefore, on the basis of the look-up table, the bathing unit controller 30 might determine that the delay time associated with a rate of temperature decrease of 0.333° C./minute is 10 minutes. Although the above example describes a rate of ambient temperature, it should be understood that the new delay time could also be calculated on the basis of a single ambient air temperature measurement.

Controlling the Water Pump 12 and the Heating Module Actuators Concurrently

Figure 7:
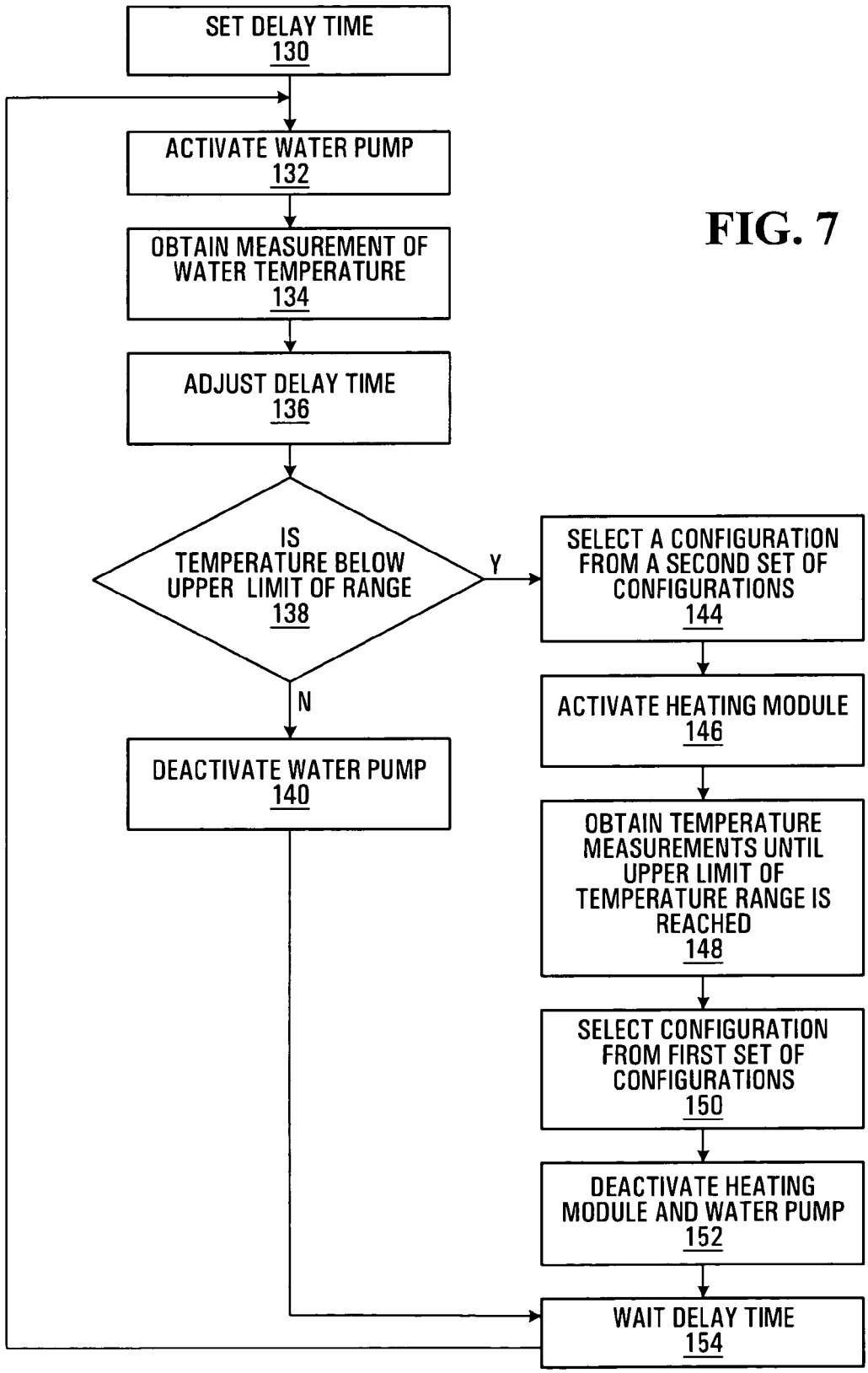
FIG. 7 shows a flow diagram of a method for calculating a delay time between the deactivation of a water pump and the re-activation of a water pump in combination with a method for maintaining the water temperature in a bathing unit, in accordance with a non-limiting example of implementation of the present invention.

Shown in FIG. 7 is a non-limiting example of a process that combines the processes described above with respect to FIGS. 4 and 6. As such, the process described with respect to FIG. 7 is a non-limiting example of a process used by the temperature regulation device 40 to control a plurality of actuators for causing the heating module 14 to acquire one of the heating state and the non-heating state, and for calculating a delay time during which the water pump 12 should be deactivated.

Steps 130 through 138 are substantially the same as steps 110 through 118 described above with respect to FIG. 6, and as such will not be described in more detail herein.

When the temperature regulation device 30 determines on the basis of the water temperature measurement taken at step 134 that the water temperature is below the upper limit of the certain temperature range, the temperature regulation device 40 proceeds to step 144. At step 144 the temperature regulation device 40 selects a configuration for the plurality of actuators 91 and 92 from the second set of actuation patterns. As mentioned above, the configurations in the second set of actuation patterns are adapted for causing the heating module 14 to acquire a heating state.

Once the temperature regulation device 40 has selected a configuration from the second set of actuation patterns, the temperature regulation device 40 derives a control signal for causing the actuators 91 and 92 to acquire the selected configuration. As such, at step 146 the temperature regulation device 40 causes the heating module 14 to acquire the heating state. In this fashion, the heating module 14 is activated (or turned "ON").

At step 148, once the heating module 14 has been activated, the temperature regulation device 40 receives signals from the temperature sensor 35 indicative of the water temperature.

At step 150, the temperature regulation device 40 processes these signal such that once the water temperature has reached or exceeded an upper limit of a certain temperature range, then the temperature regulation device 40 selects a configuration for the plurality of actuators 91 and 92 from the first set of actuation patterns. As described above, the configurations in the first set of actuation patterns are adapted for causing the heating module to acquire a non-heating state.

Once the temperature regulation device 40 has selected a configuration from the first set of actuation patterns, the temperature regulation device 40 derives a control signal for causing the actuators 91 and 92 to acquire the selected configuration. As such, at step 152 the temperature regulation device 40 causes the heating module 14 to acquire the non-heating state. In this fashion, the heating module 14 is de-activated (or turned "OFF"). At step 152 the temperature regulation device 40 also causes the water pump 12 to be deactivated, after a short delay (typically 30 seconds) to cool down the element.

Once the heating module 14 is in the non-heating state, and the water pump 12 is deactivated, at step 154 the temperature regulation device 40 waits the delay time before reactivating the water pump 12.

The remaining steps of the flow chart shown in FIG. 7 are the same as those described in relation to FIG. 6, and as such will not be described in more detail herein.

Figure 8:
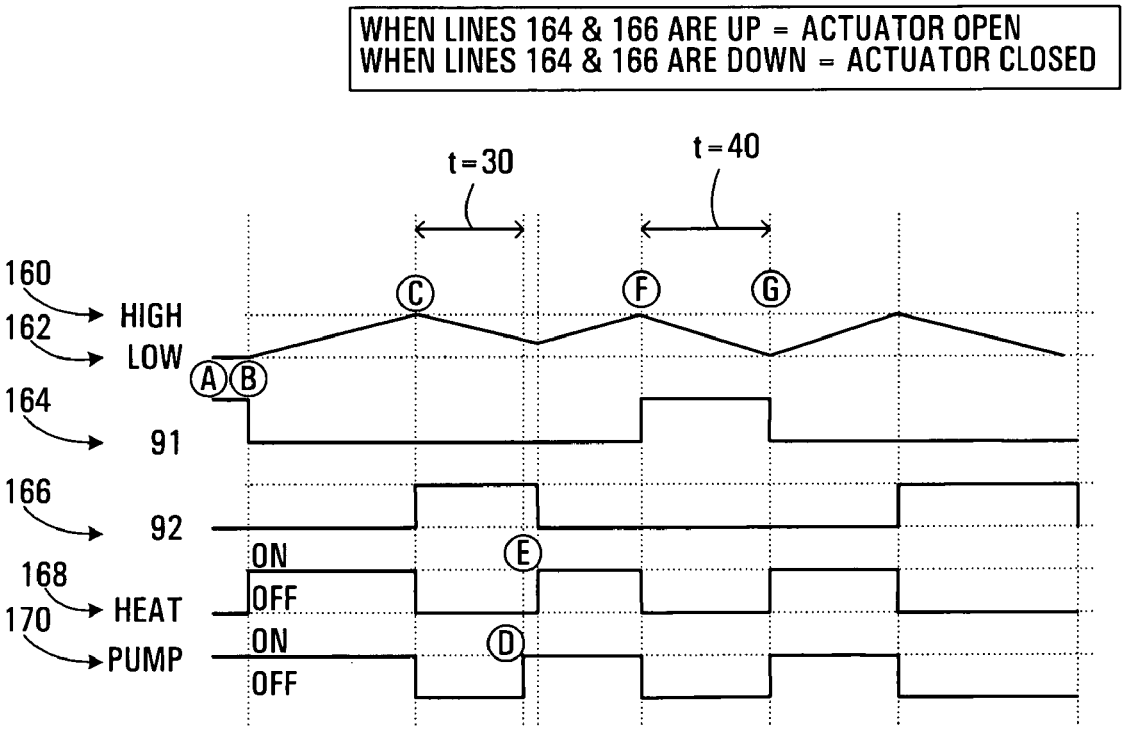
FIG. 8 shows a graph representative of the regulation of the water temperature within a bathing unit using the method shown in FIG. 7, in accordance with a non-limiting example of implementation of the present invention.

Shown in FIG. 8 is a graphical representation of the operation of the temperature regulation device 40 using the process described with respect to FIG. 7.

In the graph shown in FIG. 8, dashed line 160 represents the upper limit of a certain temperature range associated to a desired temperature, and dashed line 162 represents the lower limit of the certain temperature range. In addition, lines 164 and 166 represent control signals for causing the activation and de-activation of actuators 91 and 92, line 168 represents the state of heating module 14, and line 170 represents a control signal for causing the activation and de-activation of the water pump 12.

As described above with respect to FIGS. 5A–5C, for the non-limiting purposes of the present description, the default position for the actuators 91 and 92 is the closed position, such that when the actuators 91 and 92 are in the default position, the heating module 14 is in the heating state.

Referring now to FIG. 8, in position A, the bathing unit system 10 has just been turned on. In this position, the heating module 14 is in a non heating state, as indicated by line 168, and the water pump 12 is activated, as indicated by line 170. The portion of the graph between positions A and B indicates the state of the components during steps 130 through 136 of the process described with respect to FIG. 7. More specifically, during this period, the water pump 12 is activated in order to circulate water between the water receptacle 18 and the heating module 14 so as to obtain a uniform temperature between the two. In addition, during the period between positions A and B, the temperature regulation device 40 receives a signal from the temperature sensor 35 indicative of the temperature of the water. As shown by lines 160 and 162, the water temperature between positions A and B is in proximity to or lower than the lower limit of the certain temperature range. As such, at step 138 the temperature regulation device 40 determines that the heating module 14 needs to be activated in order to heat the water up.

The portion of the graph between positions B and C indicates the state of the components during steps 138 through 146 of the process described with respect to FIG. 7. More specifically, the temperature regulation device 40 causes the heating module 14 to be activated by causing actuators 91 and 92 to be in the default closed position, as shown by lines 164 and 166. During this period, the heating module 14 is in the heating state, as shown by line 168, and the water pump 12 is activated, as indicated by line 170.

At position C, and in accordance with step 148 of the process of FIG. 7, the temperature regulation device 40 detects on the basis of a signal from the temperature sensor 35, that the water temperature has reached or exceeded the upper limit of the temperature range. Accordingly, between positions C and D, and as indicated by lines 164 and 166, the temperature regulation device 40 in accordance with step 150 of FIG. 7, selects a configuration for the plurality of actuators 91 and 92 from the first set of actuation patterns for causing the heating module 14 to be in the non-heating state. As indicated by lines 168 and 170, during this period of time, the heating module 14 is in a non-heating state and the water pump 12 is deactivated. It is during positions C and D that the delay time elapses, during which time the water in the water receptacle 18 cools down.

At position D, the delay time during which the water pump 12 is deactivated has elapsed. As such, in accordance with step 132 of the process of FIG. 7, during the period from position D to position E, the water pump 12 is re-activated, as indicated by line 170. During this period of time, the temperature regulation device 40 performs steps 134 and 136, which are to obtain a signal indicative of the water temperature from the temperature sensor 35, and to derive a new delay time. The new delay time can be calculated on the basis of the rate of decrease of the water temperature between position C and position D.

At position E, since the water temperature has been determined to be below the upper limit of the certain temperature range, the temperature regulation device 40 proceeds once again to steps 144 and 146 described in the process of FIG. 7. As such, between position E and F, the temperature regulation device 40 causes the heating module 40 to be activated, as indicated by line 168. As such, both actuators 91 and 92 are in the default closed position.

At position F, the temperature regulation device 40 once again detects on the basis of a signal from the temperature sensor 35, that the water temperature has reached or exceeded the upper limit of the temperature range. Accordingly, the temperature regulation device 40 selects a configuration for the plurality of actuators 91 and 92 from the first set of actuation patterns for causing the heating module 14 to be in a non-heating state. As such, between positions F and G, the water in the water receptacle 18 is able to cool down in the absence of a heat source.

Since the new delay time required for the water to decrease in temperature from the upper limit of the temperature range to the lower limit of the temperature range was calculated at position D, between positions F and G the temperature regulation device 40 is able to cause the heating module 14 to acquire the non-heating state, and the water pump 12 to be deactivated for that new delay time. The skilled person in the art will appreciate that provided the rate of temperature decrease remains constant, the new delay time during which the heating module 14 is in the non-heating state and the water pump 12 is deactive, enables the water temperature to decrease entirely from the upper limit of the certain temperature range, to the lower limit of the certain temperature range. As such, the process described with respect to FIG. 7 produces a process for maintaining the water temperature within a certain time limit, that also serves to extend the lifetime of the actuators 91 and 92, and the lifetime of the water pump 12.

Physical Implementation

Those skilled in the art should appreciate that in some embodiments of the invention, all or part of the functionality associated with the temperature regulation device 40, may be implemented as pre-programmed hardware or firmware elements (e.g., application specific integrated circuits (ASICs), electrically erasable programmable read-only memories (EEPROMs), etc.) or other related components.

In other embodiments of the invention, all or part of the functionality previously described herein with respect to the temperature regulation device 40 for maintaining the water temperature in a bathing unit within a certain temperature range may be implemented as software consisting of a series of instructions for execution by a computing unit. The series of instructions could be stored on a medium which is fixed, tangible and readable directly by a computing unit (e.g., removable diskette, CD-ROM, ROM, PROM, EEPROM or fixed disk) or the instructions could be stored remotely but transmittable to the computing unit via a modem or other interface device (e.g., a communications adapter) connected to a network over a transmission medium. The transmission medium may be either a tangible medium (e.g., optical or analog communications lines) or a medium implemented using wireless techniques (e.g., microwave, infrared or other transmission schemes).

Figure 9:
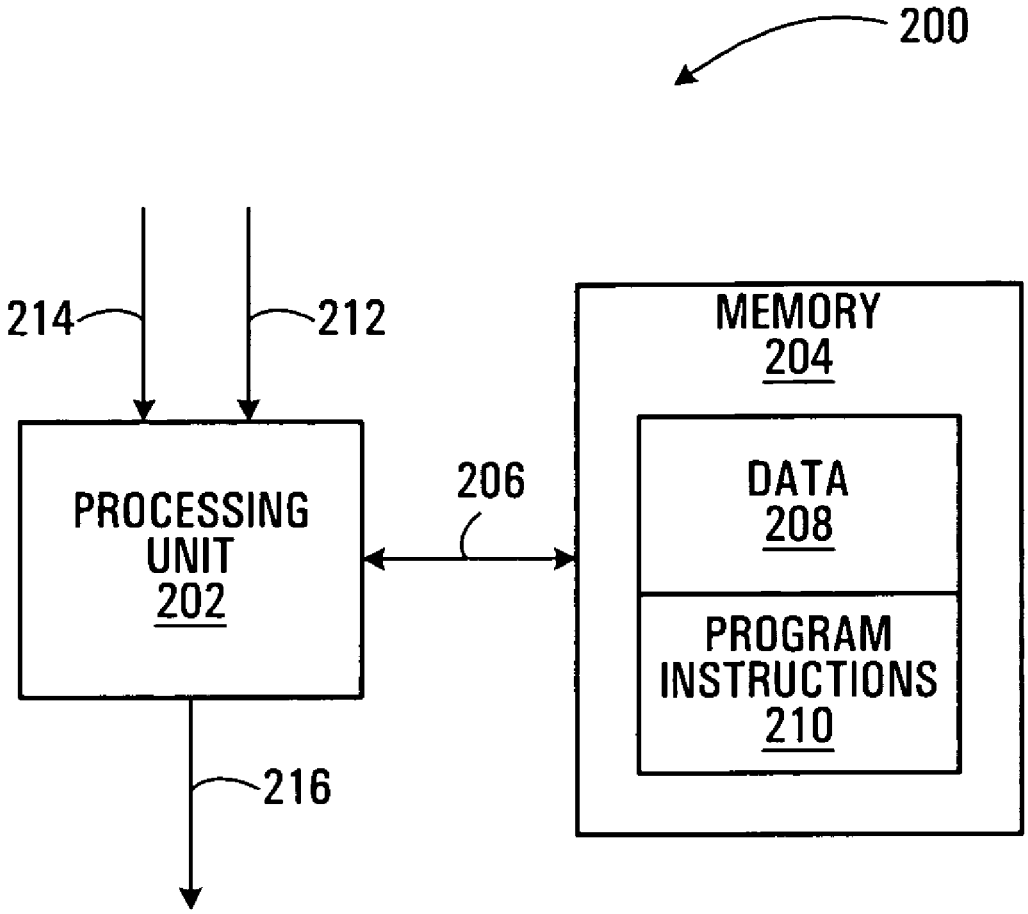
FIG. 9 shows a computing unit for implementing a temperature regulation device for maintaining the water temperature in a bathing unit within a certain temperature range, in accordance with a non-limiting example of implementation of the present invention.

The temperature regulation device 40 may also be configured as a computing unit 200 of the type depicted in FIG. 9, including a processing unit 202 and a memory 204 connected by a communication bus 206. The memory 204 includes data 208 and program instructions 210. The processing unit 202 is adapted to process the data 208 and the program instructions 210 in order to implement the process described in the specification and depicted in the drawings. The computing unit 202 may also comprise a number of interfaces 212, 214 and 216 for receiving or sending data elements to external devices. For example, interfaces 212, 214 might receive signals from the temperature sensor 35 and the water level sensor 34 as described above, and as such are used for receiving data streams. The processing unit 202 is operative for processing the received signal or signals to derive a control signal for controlling the plurality of actuators 91 and 92. Interface 216 is for releasing the control signals.

Although various embodiments have been illustrated, this was for the purpose of describing, but not limiting, the invention. Various modifications will become apparent to those skilled in the art and are within the scope of this invention, which is defined more particularly by the attached claims.

The invention claimed is:

1. A temperature control system for a bathing unit, the bathing unit including a receptacle for holding water and a heating module for heating the water supplied to the receptacle, said temperature control system comprising:

a) a plurality of actuators associated to the heating module, said plurality of actuators being adapted for acquiring:

i) a first set of actuation patterns causing the heating module to be in a non-heating state, said first set of actuation patterns including at least two configurations;

ii) a second set of actuation patterns causing the heating module to be in a heating state, said second set of actuation patterns including at least one configuration;

b) a temperature regulation device in communication with the plurality of actuators, said temperature regulation device operative for controlling said plurality of actuators such as to cause the heating module to be in either one of the heating state or the non-heating state, said temperature regulation device being adapted to select a configuration from the first set of actuation patterns for causing the heating module to be in the non-heating state, the selection being effected such as to alternate activation of the actuators in said plurality of actuators.

2. A temperature control system as defined in claim 1, wherein said temperature regulation device is further operative for:

a) receiving a signal indicative of a water temperature; and b) processing the signal indicative of the water temperature on the basis of a desired water temperature to derive a control signal;

c) controlling said plurality of actuators on the basis of said control signal such as to cause the heating module to acquire either one of the heating state or the non-heating state.

3. A temperature control system as defined in claim 2, further comprising an input for enabling a bather to provide information conveying the desired water temperature.

4. A temperature control system as defined in claim 1, wherein the plurality of actuators are connected in series.

5. A temperature control system as defined in claim 1, wherein said temperature regulation device is operative for selecting a configuration from the first set of actuation patterns on the basis of a pattern.

6. A temperature control system as defined in claim 5, wherein said pattern is a random pattern.

7. A temperature control system as defined in claim 1, wherein said first set of actuation patterns includes two configurations, said temperature regulation device being operative for selecting between said two configurations in an alternating manner.

8. A temperature control system as defined in claim 1, wherein said temperature regulation device is operative for selecting a configuration from said first set of actuation pattern for causing the heating module to acquire a non-heating state by activating at least one actuator contained in said plurality of actuators.

9. A temperature control system as defined in claim 8, wherein activating at least one actuator contained in said plurality of actuators includes opening the at least one actuator.

10. A temperature control system as defined in claim 9, wherein deactivating at least one actuator contained in said plurality of actuators causes the at least one actuator to close.

11. A temperature control system as defined in claim 10, wherein deactivating the actuators in said plurality of actuators causes the heating module to be in a heating state.

12. A temperature control system as defined in claim 1, wherein said temperature regulation device is operative for selecting a configuration from the first set of actuation pattern for causing the heating module to acquire a non-heating state by deactivating at least one actuator contained in said plurality of actuators.

13. A temperature control system as defined in claim 12, wherein deactivating at least one actuator contained in said plurality of actuators includes opening the at least one actuator.

14. A temperature control system as defined in claim 13, wherein activating at least one actuator contained in said plurality of actuators causes the at least one actuator to close.

15. A temperature control system as defined in claim 14, wherein activating the actuators in said plurality of actuators causes the heating module to be in a heating state.

16. A temperature control system as defined in claim 1, wherein said temperature control system comprises:

a) an additional actuator distinct from said plurality of actuators;

b) a safety temperature regulation device responsive to an unsafe condition event for controlling said additional actuator for causing the heating module to acquire the non-heating state.

17. A temperature control system as defined in claim 16, wherein said unsafe condition event includes the temperature of the water exceeding a certain level.

18. A temperature control system as defined in claim 1, further comprising:

a) a capacitive water level sensor adapted for obtaining a capacitance measurement associated to a level of water in the heating module;

b) said temperature regulation device being in communication with said capacitive water level sensor for:

i) processing the capacitance measurement in order to derive a second control signal;

ii) controlling said plurality of actuators on the basis of said second control signal such as to cause the heating module to acquire either one of the heating state or the non-heating state.

19. A temperature control system as defined in claim 18, wherein said capacitive water level sensor is adapted to acquire a plurality of capacitance measurements, the capacitance measurements corresponding to levels of water in a range of levels of water.

20. A method for controlling the water temperature of a bathing unit, the bathing unit including a receptacle for holding the water, a heating module for heating the water supplied to the receptacle, and a plurality of actuators associated to the heating module, the plurality of actuators being adapted for acquiring:

a) a first set of actuation patterns causing the heating module to be in a non-heating state, said first set of actuation patterns including at least two configurations;

b) a second set of actuation patterns causing the heating module to be in a heating state, said second set of actuation patterns including at least one configuration;

said method comprising:

a) receiving a signal indicative of a water temperature;

b) processing the signal indicative of a water temperature on the basis of a desired water temperature to derive a control signal;

c) controlling said plurality of actuators such as to cause the heating module to acquire either one of a heating state or a non-heating state on the basis of said control signal;

d) selecting a configuration from the first set of actuation patterns when said control signal is indicative that the heating module should acquire the non-heating state, the selection being effected such as to alternate activation of the actuators in said plurality of actuators.

21. A method as defined in claim 20, wherein said method comprises enabling a bather to provide information conveying said desired water temperature.

22. A method as defined in claim 20, wherein the plurality of actuators are connected in series.

23. A method as defined in claim 20, further comprising selecting a configuration from the first set of actuation patterns on the basis of a pattern.

24. A method as defined in claim 23, wherein said pattern is a random pattern.

25. A method as defined in claim 20, wherein the first set of actuation patterns includes two configurations, said method comprising selecting between said two configurations in an alternating manner.

26. A method as defined in claim 20, wherein said method further comprises selecting a configuration from said first set of actuation pattern for causing the heating module to acquire a non-heating state by activating at least one actuator contained in the plurality of actuators.

27. A method as defined in claim 26, wherein activating at least one actuator contained in the plurality of actuators includes opening the at least one actuator.

28. A method as defined in claim 27, wherein deactivating at least one actuator contained in the plurality of actuators causes the at least one actuator to close.

29. A method as defined in claim 28, wherein deactivating the actuators in the plurality of actuators causes the heating module to be in a heating state.

30. A method as defined in claim 20, wherein said method further comprises selecting a configuration from the first set of actuation pattern for causing the heating module to acquire a non-heating state by deactivating at least one actuator contained in said plurality of actuators.

31. A method as defined in claim 30, wherein deactivating at least one actuator contained in said plurality of actuators includes opening the at least one actuator.

32. A method as defined in claim 31, wherein activating at least one actuator contained in said plurality of actuators causes the at least one actuator to close.

33. A method as defined in claim 32, wherein activating the actuators in said plurality of actuators causes the heating module to be in a heating state.

34. A method as defined in claim 20, wherein the method further comprises:

a) processing a capacitance measurement taken by a capacitive water level sensor in communication with the heating module in order to derive a second control signal;

b) controlling the plurality of actuators on the basis of said second control signal such as to cause the heating module to acquire either one of the heating state or the non-heating state.

35. A method as defined in claim 34, wherein the capacitive water level sensor is adapted to acquire a plurality of capacitance measurements, the capacitance measurements corresponding to levels of water in a range of levels of water.

36. A method for controlling heating of water in a bathing unit, the bathing unit including a receptacle for holding water, a heating module for heating the water supplied to the receptacle and a pump for circulating the water between the receptacle and the heating module, said method comprising:

a) intermittently causing activation of the pump to cause water to circulate between the receptacle and the heating module, an activation of the pump occurring after a certain delay time after a deactivation of the pump;

b) modifying the certain delay time at least in part on the basis of temperature measurements of the water taken between successive activations of the pump and on the basis of an ambient air temperature measurement.

37. A method as defined in claim 36, wherein the pump remains active during a certain time interval following an activation of the pump, the method including causing said heating module to be in a heating state during at least a portion of the certain time interval.

38. A method as defined in claim 37, wherein said method includes causing a deactivation of the pump when a temperature measurement of the water exceeds a desired temperature.

39. A method as defined in claim 38, wherein said method comprises enabling a bather to provide information conveying said desired temperature.

40. A method as defined in claim 36, wherein said method includes modifying the certain time delay at least in part on the basis of the rate of change of the water temperature measurements taken during a deactivation of the pump.

41. A method as defined in claim 40, wherein said method further involves deriving the rate of the temperature decrease from a first temperature measurement to a second temperature measurement.

42. A method as defined in claim 36, wherein said method includes activating the pump prior to the expiry of the certain delay time in response to a certain ambient air temperature measurement.

43. A temperature control system for a bathing unit, the bathing unit including a receptacle for holding water, a heating module for heating the water supplied to the receptacle and a pump for circulating water between the receptacle and the heating module, said temperature control system comprising:

a) a temperature sensor for measuring the temperature of the water;

b) a temperature regulation device in communication with said temperature sensor, said temperature regulation device being operative for:

i) intermittently causing activation of the pump to cause water to circulate between the receptacle and the heating module, an activation of the pump occurring after a certain delay time after a deactivation of the pump;

ii) modifying the certain delay time at least in part on the basis of temperature measurements of the water taken between successive activations of the pump and on the basis of an ambient air temperature measurement.

44. A temperature control system as defined in claim 43, wherein the pump remains active during a certain time interval following an activation of the pump, said temperature regulation device being operative for causing the heating module to be in a heating state during at least a portion of the certain time interval.

45. A temperature control system as defined in claim 43, wherein said temperature regulation device is operative for causing a deactivation of the pump when a temperature measurement of the water exceeds a desired temperature.

46. A temperature control system as defined in claim 45, said temperature control system comprising an input for enabling a bather to provide information conveying said desired temperature.

47. A temperature control system as defined in claim 43, wherein said temperature regulation device is operative for modifying the certain time delay at least in part on the basis of the rate of change of water temperature measurements taken during a deactivation of the pump.

48. A temperature control system as defined in claim 47, wherein said temperature regulation device is operative for deriving the rate of the temperature decrease from a first temperature measurement to a second temperature measurement.

49. A temperature control system as defined in claim 43, wherein the pump is activated prior to the expiry of the certain delay time in response to a certain ambient air temperature measurement.

50. A method for controlling the heating of water in a bathing unit, the bathing unit including a receptacle for holding water, a heating module for heating the water supplied to the receptacle and a pump for circulating the water between the receptacle and the heating module, said method comprising:

a) intermittently causing activation of the pump to cause water to circulate between the receptacle and the heating module, an activation of the pump occurring after a certain delay time after a deactivation of the pump;

b) modifying the certain delay time at least in part on the basis of an ambient air temperature measurement.

51. A method as defined in claim 50, wherein said ambient air temperature measurement is indicative of the temperature of the air.

52. A method as defined in claim 50, wherein said ambient air temperature measurement is indicative of a rate of change of air temperature.

53. A method as defined in claim 50, wherein the pump remains active during a certain time interval following an activation of the pump, the method including causing said heating module to be in a heating state during at least a portion of the certain time interval.

54. A method as defined in claim 53, wherein said method includes causing a deactivation of the pump when a temperature measurement of the water exceeds a desired temperature.

55. A method as defined in claim 54, said method comprising enabling a bather to provide information conveying said desired temperature.

56. A temperature control system for a bathing unit, the bathing unit including a receptacle for holding water and a plurality of bathing unit components, said temperature control system comprising:

a) a circulation system through which water can flow, said circulation system comprising:
   i) a heating module for heating water; and
   ii) circulation piping connecting said heating module to the receptacle for allowing water to be exchanged between the heating module and the receptacle;

b) a solid state device operative for controlling the power supplied to said heating module, said solid state device positioned in a thermally conductive relationship with the water in said circulation system such as to allow heat to dissipate from said solid state device to water in said circulation system;

c) a temperature regulation device in communication with said solid state device, said temperature regulation device being operative for controlling said solid state device such as to regulate the amount of power supplied to said heating module, said temperature regulation device being operative for reducing the amount of current supplied to the heating module upon detection of the operation of one or more bathing unit components in said plurality of bathing unit components.

57. A temperature control system as defined in claim 56, wherein said heating module includes:

d) an outer surface;

e) an inner surface defining a passage through which water can flow, said inner surface adapted for being in contact with the water passing through said passage; and f) a conductive portion that extends from said inner surface to said outer surface;

g) said solid state device being mounted in contact with said conductive portion of said heating module such that said solid state device is in a thermally conductive relationship therewith.

58. A temperature control system as defined in claim 56, wherein said solid state device is mounted in contact with a thermally conductive portion of said circulation piping such that said solid state device is in a thermally conductive relationship therewith.

59. A temperature control system as defined in claim 56, wherein said solid state device includes a device selected from the set consisting of TRIACs, SRCs, FETs, IGBTs, MOSFETs, JFETs and BJTs (bipolar junction transistors).

60. A temperature control system as defined in claim 56, wherein said solid state device includes a TRIAC.

61. A temperature control system as defined in claim 56, wherein said solid state device is maintained in said thermally conductive relationship with said circulation system via a fastener.

62. A temperature control system as defined in claim 61, wherein the fastener includes an element selected from the set consisting of an adhesive and a mechanical fastener.

63. A temperature control system for a bathing unit, the bathing unit including a receptacle for holding water a heating module for heating the water of the receptacle and a plurality of additional bathing unit components, said temperature control system comprising:

a) at least one solid state device associated to the heating module, said solid state device being adapted for supplying power to the heating module;

b) a temperature regulation device in communication with said solid state device, said temperature regulation device being operative for controlling said solid state device such as to regulate the amount of power supplied to said heating module, said temperature regulation device being operative for reducing the amount of current supplied to the heating module upon detection of the operation of one or more bathing unit components in said plurality of additional bathing unit components.

64. A temperature control system as defined in claim 63, wherein said solid state device includes a device selected from the set consisting of TRIACs, SCRs. FETs, IGBTs, MOSFETs, JFETs and BJTs (bipolar junction transistors).

65. A temperature control system as defined in claim 63, wherein said temperature regulation device is operative to control said solid state device such that said solid state device causes the heating module to be used at a fraction of its capacity.

66. A temperature control system as defined in claim 63, wherein said temperature regulation device is operative for controlling the solid state device for reducing the amount of current supplied to the heating module.

67. A temperature control system for a bathing unit, the bathing unit including a receptacle for holding water, said temperature control system comprising:

a) a circulation system through which water can flow, said circulation system comprising:
   i) a heating module for heating water; and
   ii) circulation piping connecting said heating module to the receptacle for allowing water to be exchanged between the heating module and the receptacle;

b) a solid state device operative for controlling the power supplied to said heating module, said solid state device positioned in a thermally conductive relationship with the water in said circulation system such as to allow heat to dissipate from said solid state device to water in said circulation system;

c) a temperature regulation device in communication with said solid state device, said temperature regulation device being operative for:
   i) receiving information conveying a water temperature associated with water in the receptacle of the bathing unit;
   ii) when the water temperature is below a certain desired temperature, controlling the solid state device to supply power to the heating module at a first energy level;
   iii) when the water temperature is above the certain desired temperature, controlling the solid state device to supply power to the heating module at a second energy level, the second energy level being a lower energy level than the first energy level.

68. A temperature control system as defined in claim 67, wherein said heating module includes:

a) an outer surface;

b) an inner surface defining a passage through which water can flow, said inner surface adapted for being in contact with the water passing through said passage; and c) a conductive portion that extends from said inner surface to said outer surface;

d) said solid state device being mounted in contact with said conductive portion of said heating module such that said solid state device is in a thermally conductive relationship therewith.

69. A temperature control system as defined in claim 67 wherein said solid state device is mounted in contact with a thermally conductive portion of said circulation piping such that said solid state device is in a thermally conductive relationship therewith.

70. A temperature control system as defined in claim 67 wherein said temperature regulation device is operative to control said solid state device such that said solid state device causes the heating module to be used at a fraction of its capacity.

71. A method a method for controlling the water temperature of a bathing unit, the bathing unit including a receptacle for holding the water, a circulation system including a heating module and circulation piping, the heating module being for heating the water supplied to the receptacle, the circulation piping connecting the heating module to the receptacle for allowing water to be exchanged between the heating module and the receptacle, said method comprising:

a) receiving a signal indicative of a water temperature;

b) providing a solid state device operative for controlling the power supplied to the heating module, the solid state device being positioned in a thermally conductive relationship with the water in said circulation system such as to allow heat to dissipate from said solid state device to water in said circulation system;

c) processing the signal indicative of a water temperature on the basis of a desired water temperature to derive a control signal, the control signal being adapted for:

i) when the signal indicative of a water temperature conveys a water temperature below the certain desired temperature, controlling the solid state device to supply power to the heating module at a first energy level;

ii) when the signal indicative of a water temperature conveys a water temperature above the certain desired temperature, controlling the solid state device to supply power to the heating module at a second energy level, the second energy level being a lower energy level than the first energy level.

72. A method as defined in claim 71, wherein said control signal is operative to control said solid state device such that said solid state device causes the heating module to be used at a fraction of its capacity.

* * * * *